US007600472B2

(12) United States Patent
Igarashi et al.

(10) Patent No.: US 7,600,472 B2
(45) Date of Patent: Oct. 13, 2009

(54) PUMP CONTROL MECHANISM, PRINTER USING THE SAME AND PUMP CONTROL METHOD

(75) Inventors: Hitoshi Igarashi, Nagano (JP); Kaoru Koyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 459 days.

(21) Appl. No.: 11/378,374

(22) Filed: Mar. 20, 2006

(65) Prior Publication Data

US 2006/0239828 A1 Oct. 26, 2006

(30) Foreign Application Priority Data

Mar. 18, 2005 (JP) ..... P2005-079339
Mar. 18, 2005 (JP) ..... P2005-079340

(51) Int. Cl.
*B41F 31/02* (2006.01)
*B41J 2/175* (2006.01)
*B41J 29/393* (2006.01)
*F04B 49/00* (2006.01)

(52) U.S. Cl. ..... 101/366; 347/85; 347/19; 417/22

(58) Field of Classification Search ..... 101/366; 347/19, 85; 417/22, 32, 412, 472, 489; 222/621, 222/209

See application file for complete search history.

(56) References Cited

U.S. PATENT DOCUMENTS 5,917,526 A * 6/1999 Wilson et al. ..... 347/86
6,797,181 B2 * 9/2004 Morse et al. ..... 210/745
7,131,720 B2 * 11/2006 Mizuno et al. ..... 347/92
7,240,999 B2 * 7/2007 Kumagai et al. ..... 347/85
7,287,842 B2 * 10/2007 Aruga ..... 347/84
2005/0046681 A1 * 3/2005 Kumagai et al. ..... 347/85
2006/0071965 A1 * 4/2006 Igarashi et al. ..... 347/19
2008/0180476 A1 * 7/2008 Igarashi ..... 347/14

FOREIGN PATENT DOCUMENTS

JP 2002-510252 A 4/2002
WO WO 98/47713 A1 10/1998

* cited by examiner

*Primary Examiner*—Judy Nguyen
*Assistant Examiner*—Leo T Hinze
(74) *Attorney, Agent, or Firm*—Sughrue Mion, PLLC

(57) ABSTRACT

A pump control mechanism includes a pump unit for feeding liquid to container, a position detector for detecting the position in the reciprocating motion of the pump member, a control table having control information of many time zone sections, an information memory for storing target information corresponding to a target driving speed, a driving information calculator for calculating driving information of a motor on the basis of the reciprocating position detection, a correcting information calculator for calculating correction information for reducing the difference between the driving information and the target information, and a corrector for correcting the control table. The control table has individual control information for each of time zone sections for increasing/reducing the driving force in accordance with the magnitude of the load of the motor, and a control information increasing section for locally increasing the driving force in connection with a case where a large load locally acts on the motor exists in the control table.

3 Claims, 14 Drawing Sheets

PUMP CONTROL MECHANISM, PRINTER USING THE SAME AND PUMP CONTROL METHOD

BACKGROUND OF THE INVENTION

1. Technical Field of the Invention

The present invention relates to a pump control mechanism, a printer using the pump control mechanism and a pump control method.

2. Description of the Related Art

Many popular type printers are designed so that an ink-stored cartridge is mounted on a carriage. However, there is known such a high-performance type of printer that a cartridge is not mounted on a carriage, but a cartridge is mounted at the housing side of the printer. In this type of printer, the variation of the weight of the carriage can be suppressed even when the residual amount of ink is varied. Therefore, this type of printer can perform high-precision control on the movement of the carriage.

Here, in the above type of printer, a liquid container is mounted on a carriage. A cartridge is connected to the liquid container through a liquid pipe line so that ink can be supplied from the cartridge to the liquid container. Furthermore, the cartridge is connected to one end side of an air pipe line. The other end side of the air pipe line is connected to a bellows pump in a pump unit. By driving the bellows pump, air is fed through the air pipe line into the cartridge. Ink can be supplied from the cartridge through the liquid pipe line into the liquid container by air pressure.

JP-T-2002-510252 (see page 8, FIG. 1) discloses a construction using air pressure as described above. The construction disclosed in the Patent Document 1 is equipped with a reciprocating portion that is reciprocated to compress air, a pump motor for reciprocating the reciprocating portion and a power supply portion for supplying power to the pump motor until the pressure of the liquid container reaches a predetermined pressure.

When a bellows pump is driven by a pump motor, there occurs a problem that noise occurs from noise sources such as the pump motor, a conversion mechanism, etc. These noises out of operating sounds occurring from a printer are particularly large, and it has been required to reduce these noises.

Particularly when the bellows pump is expanded and contracted, the load acting on the pump motor is varied in accordance with variation of the internal pressure of the bellows pump, and the rotational number of the pump motor is also varied in accordance with the variation of the internal pressure concerned, so that the noise is also varied in accordance with the variation of the rotational number. When the noise is varied in accordance with the rotational number, the noise more easily jars unpleasantly on the ear as compared with a case where a sound having a fixed level statitionarily occurs from a noise source. That is, in the case of the same level noise, a sound varying in magnitude makes a human feel more noisy than a sound fixed in magnitude.

Here, when the above-described pump motor is controlled, for example by mounting a sensor that can detect the rotational number of a rotary encoder or the like and actively using a feedback signal from the sensor to control the rotational number of the pump motor, the noise can be reduced. However, when a rotary encoder or the like is mounted, there is a problem that it causes rise-up of the cost, etc. Therefore, it has been required that the noise can be reduced without using any rotary encoder by the detection of a position detecting sensor and a pressure sensor which has been already equipped to the pump unit.

Furthermore, when the bellows pump is driven, there also occurs a problem that the actual load acting on the pump motor is greatly varied in magnitude. Therefore, when a locally large load acts on the pump motor, the pump motor does not overcome the load concerned and thus the pump motor is stopped at that portion.

The stop problem described above is more remarkable as the use term of a printer is longer. That is, when the use term of the printer is increased, the influence of external disturbance factors such as degradation of the fabrication precision of mechanical parts, adhesion of dust from the outside, etc., which are not considered as design matters at the initial stage, is more intense. The influence of the external disturbance described above is frequently further applied to load-large parts which have hitherto existed.

For example, it is assumed that a mechanically jouncing part has existed from the initial stage of the Manufacturing of a printer, an impact load is caused by the jouncing and thus there exists a portion at which the load is locally increased. Accordingly, when the use term of the printer is increased, it is an usual case that the fabrication precision is generally degraded because of abrasion due to friction or the like, loose of screws or the like, and the impact load is further increased. In this case, there frequently occurs such a case that variation in magnitude of the load is further intensified and thus the pump motor is stopped. The problem that the variation width in magnitude of the load is increased as the printer is used for a longer term is also likewise caused by other elucidated factors/non-elucidated factors.

As described above, in addition to the promotion of quietness, it is necessary in the printer to prevent the pump motor from being stopped in process of its operation due to variation in magnitude of the load, and both of them are required to be compatibly satisfied. Here, in order to prevent the pump motor from being stopped in process of its operation, the voltage/current to be applied to the pump motor may be increased. However, in this case, the rotational speed of the pump motor is increased, and thus it is difficult to implement quietness in the pump unit.

On the other hand, the stop problem described above is apt to occur at a portion at which the pump motor starts to move. That is, when the load imposed on the pump motor is large at the portion where the pump motor starts to move, the pump motor cannot start to move, and kept stopped for a predetermined time. Particularly when the pump motor moves immediately after the pressure rises up, the stop problem concerned frequently occurs in accordance with the stop position of the pump motor. Therefore, there is a problem that it takes a time for the pump motor to start its motion or the pump motor is kept stopped and cannot move.

Here, when the pump motor cannot start to move, the pump motor can normally start to move if the voltage/current corresponding to the large load is applied. However, in this case, it is required to mount an expensive pump motor in order to adapt the pump motor to the large load. Furthermore, when application of current/voltage is awaited until a portion to which the current/voltage corresponding to the peak of the load should be applied comes, the phase of the voltage/current applied to the pump motor is displaced. Therefore, the large current/voltage is applied to a portion on which a small load is imposed, and thus the rotational number of the pump motor is varied.

As described above, with respect to the printer, it has been required not only make the pump unit quiet, but also to enable the pump motor to start to move surely.

SUMMARY OF THE INVENTION

The present invention has been implemented on the basis of the above-described situation, and has a first object to provide a pump control mechanism that can reduce variation of noise within one cycle to promote quietness, and also prevent a motor from being stopped in process of its operation, a printer using the pump control mechanism and a pump control method.

The present invention also has a second object to provide a pump control mechanism that can reduce variation of noise within one cycle to make quiet, and also make a pump motor to start to move surely, a printer using the pump control mechanism and a pump control method.

In order to solve at least one of the problems, an embodiment of the present invention is equipped with a pump unit having a pump member giving air pressure through a reciprocating motion and a motor that reciprocates the pump member and is controlled on the basis of control information, the pump unit reciprocating the pump member by the driving of the motor to feed liquid stored in a liquid supply source to container, and an information memory for storing a control table having many control information and target information corresponding to a target driving speed when the motor is driven, wherein the control table has individual control information for each of many segmentalized time zone sections, the control information increases/reduces the driving force of the motor in connection with the magnitude of the load of the motor, and a control information increasing section to locally increase the driving force of the motor in connection with a case where a large load locally acts on the motor exists in the control information of these time zone sections.

In the case of the above construction, the driving of the motor is controlled on the basis of the control table read from the information memory. Here, the control table is segmentalized to many time zone sections, and the driving force of the motor is increased/reduced in accordance with the magnitude of the load of the motor in each time zone. The variation of the driving speed of the motor can be suppressed by applying the control table to the motor, thereby suppressing the variation of noise occurring from load portions such as the pump member and other friction portions and thus reducing noisy sounds.

The control information increasing section exists in the control information of the time zone sections of the control table. Therefore, even when a large load locally acts on the motor, the motor can be prevented from being stopped by the load, and the driving of the motor can be continued. Particularly when the use term is long and the load is increased, the stop of the motor can be excellently prevented. Furthermore, the driving of the motor can be stabilized. In addition, it is unnecessary to increase the limit torque of the motor in connection with the action of the large load. Therefore, it is unnecessary to use an expensive motor having a large output, and thus the cost can be reduced.

Furthermore, another embodiment comprises: a pump unit equipped with a pump member for acting air pressure through a reciprocating motion, and a motor that reciprocates the pump member and is controlled on the basis of control information, the pump unit reciprocating the pump member by the driving of the motor to feed liquid stored in a liquid supply source to container; a position detector for detecting the position in the reciprocating motion of the pump member; an information memory for storing target information corresponding to a target driving speed when the motor is driven; a driving information calculator for calculating the driving information corresponding to the driving speed of the motor for reciprocating the motor on the basis of the position detection of the pump member by the position detector; a correction information calculator for reducing the difference between the driving information and the target information when the motor is next driven and calculating correction information for the control table; and a corrector for correcting the control table applied to the motor on the basis of the correction information, wherein the control table has individual control information for each of many segmentalized time zone sections, increases/reduces the driving force of the motor in connection with the magnitude of the load of the motor, and the control information of the time zone sections contains a control information increasing section for locally increasing the driving force of the motor in connection with a case where a large load locally acts on the motor.

In the case of the above construction, the driving information calculator calculates the driving information corresponding to the driving speed of the motor on the basis of the detection of the reciprocating motion of the pump member by the position detector. The correction information calculator compares the calculated driving information with the target information, and calculates the correction information to reduce the difference from the target information. Furthermore, the corrector corrects the control table stored in the information memory in advance. Accordingly, each control information in the control table is corrected on the basis of the correction information. On the basis of the corrected control table, the driving of the motor is controlled, and the driving speed of the motor approaches to the target driving speed.

Here, the control table is segmentalized into the many time zone sections, and the driving force of the motor is increased/reduced in accordance with the magnitude of the load of the motor in each time zone. Therefore, the variation of the driving speed of the motor can be suppressed by applying the control table to the motor. Accordingly, the variation of the noise occurring from load portions such as the pump member and other friction portions can be suppressed, and thus the noisy sounds can be reduced. In addition, the driving speed of the motor is corrected to approach to the target driving speed. Therefore, the noise occurring from the load portions can be suppressed. That is, if the target information is set so that the occurring noise is out of the audible area, the occurrence of the noise can be reduced on the basis of the detection of the position detector as the motor is driven, so that the variation of the noise can be also suppressed. Furthermore, the occurrence of the noise can be suppressed by only the detection of the position detector. Therefore, it is unnecessary to provide an encoder or the like to detect the driving speed of the motor, and thus the cost can be prevented from rising up.

Furthermore, the control information increasing section exists in the control information of the time zone section of the control table. Therefore, even when a large load locally acts on the motor, the motor can be prevented from being stopped by the load, and thus the driving of the motor can be continued. Particularly when the use term is long and the load is increased, the motor can be excellently prevented from being stopped. Furthermore, the driving of the motor can be stabilized. Furthermore, it is unnecessary to increase the limit torque of the motor in connection with the action of the large load. Therefore, it is unnecessary to use an expensive motor having a large output, and thus the cost can be reduced.

Furthermore, according to another embodiment, in addition to the above-described embodiment, a control information reducing section for locally reducing the driving force of the motor exists in the control information. In the case of the above-described construction, since the control information reducing section exists in the control information of the time zone sections, the average of the control information can be prevented from increasing. Therefore, the motor can be prevented from being rotated faster more than necessary, and the noise occurring from sliding portions such as the pump unit, etc. can be suppressed. Furthermore, when a small load locally acts on the motor, it can be adapted to the locally small load.

Furthermore, according to another embodiment, in addition to the above-described embodiment, the control table contains an area where the control information increasing section and the control information reducing section are alternately repeated. In the case of the above-described construction, the control information increasing section and the control information reducing section are alternately repeated in that area. Therefore, the control information increasing section is applied to the motor to increase the driving force of the motor, and then the control information reducing section is applied to the motor to reduce the driving force of the motor. Accordingly, the rotational speed of the motor can be prevented from being increased to a higher value than necessary, so that the motor can be rotated at the rotational speed corresponding to the target information.

According to another embodiment, in addition to the above-described embodiment, the average of the control information in the area where the control information increasing section and the control information reducing section are alternately repeated is set to be larger than the average of the control information required to drive the motor in that area.

In the case of the above-described construction, by applying the control information to the motor, the more can be surely driven. Furthermore, by setting the average of the control information to a larger value than the average of the control information required to drive the motor in that area, the motor can be surely driven even when the load of the motor is slightly varied due to variation of the outside air temperature, increase of the friction or the like. Furthermore, even when a load larger than an expected load acts on the motor, the motor can be started.

Furthermore, according to another embodiment, in addition to each of the above-described embodiments, the control information is a Duty ratio for carrying out PWM control at a pulse voltage applied to the motor, and the Duty ratio corresponding to each control information is individually increased/reduced from a reference value on the basis of the variation of the load within one cycle of the pump member which is measured in advance, thereby constructing a control table, and the correction information is set to a value for changing the Duty ratio of the pulse voltage in the PWM control.

In the above-described case, the driving speed of the motor can be adjusted by the PWM control, and the motor can be surely controlled although it is simple. Furthermore, each control information constituting the control table individually increases/reduces the Duty ratio from the reference value on the basis of the variation of the load within one cycle of the pump member which is measured in advance. Therefore, the minute control can be performed within one cycle of the reciprocating motion of the pump member, and the variation of the speed can be further suppressed.

Furthermore, according to another embodiment, in addition to each of the above-described embodiments, the position detector detects the position in the reciprocating motion of the pump member at the expansion end side of the pump member. In this case, when the motor is next driven and the position of the pump member is detected by the position detector, the time until the detection concerned corresponds to the initial cycle. That is, at the initial stage of the position detection, the accurate cycle measurement can be performed Furthermore, according to another embodiment, the pump control mechanism of each embodiment described above is used for a printer, the container is a liquid container existing in a carriage, the liquid is ink and the liquid supply source is a cartridge for storing ink.

In the case of the above-described construction, the variation of the driving speed of the motor in the pump control mechanism can be suppressed in the printer, and the variation of the noise occurring from the load portions can be suppressed, so that the noisy sound can be reduced. In addition, the driving speed of the motor is corrected to approach to the target driving speed, whereby the noise occurring from the load portion can be suppressed. The occurrence of the noise can be suppressed by only the detection of the position detector, so that the rise-up of the cost can be suppressed. Furthermore, the control information increasing section exists, and thus even when the large load locally acts on the motor, the motor can be prevented from being stopped by the load, so that the driving of the motor can be continued.

Furthermore, according to another embodiment, a pump control method for feeding liquid stored in a liquid supply source to container by using a pump unit comprising a pump member giving air pressure by a reciprocating motion, and a motor that reciprocates the pump member and is controlled on the basis of control information comprises: a read-out step of reading out a control table, wherein the control table concerned is stored in an information memory in advance, individual control information for each of many segmentalized time zone sections exists in the control table, the control information increases/reduces the driving force of the motor in connection with the magnitude of the load of the motor, and a control information increasing section for locating increasing the driving force of the motor in connection with a case where a large load locally acts on the motor exists in the control information of the time zone sections; an initial driving step of driving the motor on the basis of the control table read out in the read-out step to reciprocate the pump unit by the driving of the motor; a position detecting step of detecting the position in the reciprocating motion of the pump member; a driving information calculating step of calculating driving information corresponding to the driving speed of the motor for reciprocating the pump member on the basis of the position detection of the pump member in the position detecting step; a correction information calculating step of comparing the driving information calculated in the driving information calculating step with target information corresponding to a target driving speed of the driving of the motor stored in the information memory in advance, and calculating, on the basis of the comparison result, correction information to reduce the difference between the driving information and the target information when the motor is next driven; a correcting step for correcting the control table applied to the motor on the basis of the correction information; and a correction driving step of driving the motor on the basis of the control information corrected on the basis of the correction information.

In the case of the above-described construction, the control table is read out from the information memory in the read-out step. In the initial driving step, the motor is driven on the basis of the read-out control table, and the reciprocating motion of the pump unit is carried out. In the position detecting step, the position in the reciprocating motion of the pump member is detected, and the driving information of the motor is calculated on the basis of the detection concerned in the driving information calculating step. In the correction calculating step, the calculated driving information and the target information are compared with each other, and the correction information to reduce the difference from the target information is calculated. Furthermore, in the correcting step, the control table stored in the information memory in advance is corrected on the basis of the calculated correction information. Accordingly, each control information in the control table is corrected on the basis of the correction information. In the correction driving step, the driving of the motor is controlled on the basis of the corrected control information, and the driving speed of the motor approaches to the target driving speed.

Here, the control table is segmentalized to many time zone sections, and the driving force of the motor is increased/reduced in accordance with the magnitude of the load of the motor in each time zone. Therefore, by applying the control table to the motor, the variation of the driving speed of the motor can be suppressed. Accordingly, the variation of noise occurring from load portions such as the pump member and other friction portions can be suppressed, so that the noisy sound can be reduced. In addition, the driving speed of the motor is corrected to approach to the target driving speed. Therefore, the noise occurring from the load portions can be suppressed. That is, if the target information is set so that the occurring noise is out of the audible area, the occurrence of the noise can be reduced on the basis of the detection in the position detecting step as the motor is driven, and thus the variation of the noise can be also suppressed. Furthermore, the occurrence of the noise can be suppressed by only the detection in the position detecting step. Therefore, it is unnecessary to use an encoder or the like to detect the driving speed of the motor, and thus the cost can be prevented from rising up.

Further in order to solve at least one of the above problems, an embodiment of the present invention is equipped with a pump unit comprising a pump member for giving air pressure through a reciprocating motion and a motor that reciprocates the pump member and is controlled on the basis of control information, the pump unit reciprocating the pump member by the driving of the motor to feed liquid stored in a liquid supply source to container, and an information memory for storing a control table having many control information and corresponding to the cycle of the reciprocating motion of the pump member, and target information corresponding to a target driving speed when the motor is driven, wherein the control information at the last portion of the cycle of the control table increases the driving force of the motor to a higher value as compared with the control information at the initial portion of the cycle.

In the case of the above-described construction, the driving of the motor is controlled on the basis of the control table read from the information memory. Here, the control table corresponds to the cycle of the reciprocating motion of the pump member, and also the control information at the last portion of the cycle concerned increases the driving force of the motor to a higher value as compared with the control information at the initial portion of the cycle concerned. Therefore, the output of the motor at the last portion is increased, and even when a load acting on the motor at the last portion is large, the load can be overcome. Therefore, there can be prevented such a disadvantage that at the last portion, a large load cannot be overcome, and the large load concerned keeps its action on the motor at the next start time and thus the motor cannot move, or it takes a time for the motor to move.

Accordingly, it can be prevented that the phase of the motor is displaced because it is impossible for the motor to start to move at the start time. Therefore, it can be prevented that a large voltage/current is applied to a small-load portion and thus the rotational number of the motor is varied. As described above, by preventing the variation of the rotational number of the motor, variation of noise occurring from a load portion such as the pump member or other friction portions can be suppressed, so that the noisy sound can be reduced.

Furthermore, another embodiment is equipped with a pump unit comprising a pump member for giving air pressure by reciprocating motion and a motor that reciprocates the pump member and is controlled on the basis of control information, the pump unit reciprocating the pump member by the driving of the motor to feed liquid stored in a liquid supply source to container, a position detector for detecting the position of the pump member in the reciprocating motion, an information memory for storing a control table having many control information and corresponding to the cycle of the reciprocating motion of the pump member, a driving information calculator for calculating driving information corresponding to the driving speed of the motor for reciprocating the pump member on the basis of the position detection of the pump member by the position detector, a correction information calculator comparing driving information and target information to reduce, on the basis of the comparison result, the difference between the driving information and the target information when the motor is next driven, and calculating correction information for the control table, and a corrector for correcting the control table input to the motor on the basis of the correction information, wherein the control table is equipped with individual control information for each of many segmentalized time zone sections, the control information increases/reduces the driving force of the motor in connection with the magnitude of the load imposed on the motor, and the control information in the time zone section corresponding to the last portion of the cycle increases the driving force of the motor to a higher value as compared with the control information in the time zone section corresponding to the initial portion of the cycle.

In the case of the above-described construction, the driving information calculator calculates the driving information corresponding to the driving speed of the motor on the basis of the detection of the reciprocating motion of the pump member in the position detector. The correction information calculator compares the calculated driving information and the target information, and calculates the correction information to reduce the difference from the target information. Furthermore, the corrector corrects the control table pre-stored in the information memory on the basis of the calculated correction information. Each control information in the control table is also corrected on the basis of the correction information. The driving of the motor is controlled on the basis of the corrected control table, and the driving speed of the motor approaches to a target driving speed.

Here, the control table corresponds to the cycle of the reciprocating motion of the pump member, and also the control information in the time zone section corresponding to the last portion of the cycle increases the driving force of the motor to a higher value as compared with the time zone section corresponding to the initial portion of the cycle. Therefore, the output of the motor at the last portion is large, and thus even when the load acting on the motor at the last portion is large, the load can be overcome. Therefore, there can be prevented such a disadvantage that the large load cannot be overcome at the last portion, and thus the motor cannot start to move while the large load concerned is still imposed at the next start time, or it takes a time for the motor to move. Accordingly, the phase of the motor can be prevented from being displaced because it is impossible for the motor to start to move at the start time. Therefore, it can be prevented that a large current/voltage is applied to a load-small portion and thus the rotational number of the motor is varied. As described above, by preventing the variation of the rotational number of the motor, the variation of noise occurring from a load portion such as the pump member or other friction portions can be suppressed, and thus the noisy sound can be reduced.

In addition, the driving speed of the motor is corrected to approach to the target driving speed. Therefore, the noise occurring from the load portion can be suppressed. That is, by setting the target information so that the occurring noise is out of an audible area, occurrence of the noise can be reduced on the basis of the detection of the position detector as the motor is driven, and the variation of the noise is also allowed to be suppressed. Furthermore, the occurrence of the noise can be suppressed by only the detection of the position detector. Therefore, it is not required to provide an encoder or the like to detect the driving speed of the motor, and the rise-up of the cost can be suppressed. Furthermore, it is not required to increase the limit torque of the motor in connection with the action of the large load. Therefore, it is unnecessary to use an expensive motor having a large output, and thus the cost can be reduced.

Furthermore, according to another embodiment, in addition to each of the above-described embodiments, the peak of the load in the control table exists at a site between the initial portion and the last portion of the cycle of the control table, and the control information at the last portion of the cycle is increases the driving force of the motor to a high value as compared with the average control information of the cycle.

In the case of the above-described construction, when the control information of the last portion is applied, the output of the motor is larger than the average control information of the cycle. Therefore, even when the load acting on the motor at the last portion is high, the load can be sufficiently overcome.

According to another embodiment, in addition to the above-described embodiment, when the driving speed of the motor exceeds a fixed threshold value, the control information preceding to that of the last portion reduces the driving force of the motor to a higher value as compared with the control information of the initial portion. In the case of the above-described construction, when the driving speed of the motor is so high as to exceed the fixed threshold value, the driving force of the motor can be reduced to a lower value by the control information preceding to that of the last portion as compared with the control information of the initial portion. Therefore, the driving speed of the motor can be reduced and set within the threshold value, so that the speed variation can be reduced.

Furthermore, according to another embodiment, in addition to the above-described embodiment, the control information is a Duty ratio for carrying out PWM control in a pulse voltage applied to the motor, the Duty ratio corresponding to individual control information is individually increased/reduced from a reference value on the basis of pre-measured variation of the load within one cycle of the pump member to construct a control table, and the correction information is set to a value for changing the Duty ratio of the pulse voltage in the PWM control.

In the case of the above-described construction, the driving speed of the motor can be adjusted by the PWM control, and the motor can be accurately controlled although it is simple. Each control information constituting the control table individually increases/reduces the Duty ratio from the reference value on the basis of the pre-measured load variation within one cycle of the pump member. Therefore, the fine control can be performed within one cycle of the reciprocating motion of the pump member, and the variation of the speed can be further suppressed.

Furthermore, according to another embodiment, in each of the above-described embodiments, the position detecting unit detects the position in the reciprocating motion of the pump member at the expansion end side of the pump member, and the expansion end serves as the boundary between the adjacent cycles. In this case, when the motor is next driven and the position of the pump member is detected by the position detector, the time elapsing until the detection concerned is the first cycle. That is, at the first position detecting stage, the accurate cycle measurement can be performed.

Furthermore, according to another embodiment, the pump control mechanism according to each of the above-described embodiments is applied to a printer, and also the container is a liquid container existing in a carriage, liquid is ink, and a liquid supply source is a cartridge in which ink is stored.

In the case of the above-described construction, in the printer, it can be prevented that the phase of the motor is displaced because it is impossible for the motor to start to move at the start time in the pump control mechanism. Therefore, it can be prevented that a large voltage/current is applied to a load-small portion and thus the rotational number of the motor is varied. Furthermore, the variation of the driving speed of the motor can be suppressed, and the variation of the noise occurring from the load portion can be suppressed, so that the noisy sound can be reduced. In addition, the driving speed of the motor is corrected to approach to the target driving speed, whereby the noise occurring from the load portion can be suppressed. Furthermore, occurrence of the noise can be suppressed by only the detection of the position detector, so that the rise-up of the cost can be suppressed. Furthermore, by the existence of the control information increasing section, even when a local large load acts on the load, the motor can be prevented from stopping due to the load, and the driving of the motor can be continued.

Furthermore, according to another embodiment, a pump control method for feeding liquid stored in a liquid supply source to container by using a pump unit equipped with a pump member for acting air pressure by reciprocating motion and a motor that reciprocates the pump member and also is controlled on the basis of control information, comprising: a read-out step of reading out a control table that corresponds to the cycle of the reciprocating motion of the pump member and is pre-stored in an information memory, individual control information existing for each of many segmentalized time zone sections in the control table, and control information in the time zone section corresponding to the last portion of the cycle increasing the driving force of the motor to a higher value as compared with the control information of the time zone section corresponding to the initial portion of the cycle; an initial driving step of driving the motor on the basis of the control table read out in the read-out step and reciprocating the pump unit by the driving of the motor; a position detecting step for detecting the position of the pump member in the reciprocating motion; a driving information calculating step of calculating the driving information corresponding of a driving speed of the motor for reciprocating the pump member; a correction information calculating step of comparing the driving information calculated in the driving information calculating step with target information corresponding to a target driving speed of the motor driving pre-stored in the information memory, and calculating, on the basis of the comparison result, correction information for reducing the difference between the driving information and the target information when the motor is next driven; a correcting step of correcting the control table input to the motor on the basis of the correction information; and a correcting driving step of driving the motor on the basis of the control information corrected on the basis of the correction information.

In the case of the above-described construction, the control table is read out from the information memory in the read-out step. In the initial driving step, the motor is driven on the basis of the read-out control table, and the pump unit is reciprocated. In the position detecting step, the position in the reciprocating motion of the pump member is detected, and the driving information of the motor is calculated on the basis of the detection concerned in the driving information calculating step. In the correction information calculating step, the calculated driving information and the target information are compared with each other, and the correction information to reduce the difference from the target information is calculated. Furthermore, in the correcting step, the control table stored in the information memory in advance is corrected on the basis of the calculated correction information. In this case, each control information in the control table is also corrected on the basis of the correction information. Furthermore, in the correction driving step, the driving of the motor is controlled on the basis of the corrected control information, and the driving speed of the motor approaches to the target driving speed.

Here, the control table corresponds to the cycle of the reciprocating motion of the pump member, and the control information at the last portion of the cycle thereof increases the driving force of the motor to a higher value than the control information at the initial portion of the cycle. Therefore, the output of the motor at the last portion is increased, and even when the load acting on the motor is large at the last portion, the load concerned can be overcome. Therefore, there can be prevented such a disadvantage that the large load cannot be overcome at the last portion, and thus the motor cannot start to move while the large load concerned is still imposed at the next start time, or it takes a time for the motor to move. Accordingly, the phase of the motor can be prevented from being displaced because it is impossible for the motor to start to move at the start time. Therefore, it can be prevented that a large current/voltage is applied to a load-small portion and thus the rotational number of the motor is varied. As described above, by preventing the variation of the rotational number of the motor, the variation of noise occurring from a load portion such as the pump member or other friction portions can be suppressed, and thus the noisy sound can be reduced.

In addition, the driving speed of the motor is corrected to approach to the target driving speed. Therefore, the noise occurring from the load portion can be suppressed. That is, by setting the target information so that the occurring noise is out of an audible area, the occurrence of the noise can be reduced on the basis of the detection in the position detecting step as the motor is driven, and also the variation of the noise is allowed to be suppressed. Furthermore, the occurrence of the noise can be suppressed by only the detection in the position detecting step. Therefore, it is not required to provide an encoder or the like to detect the driving speed of the motor, and the rise-up of the cost can be suppressed. Furthermore, it is not required to increase the limit torque of the motor in connection with the action of the large load. Therefore, it is unnecessary to use an expensive motor having a large output, and thus the cost can be reduced.

DETAILED DESCRIPTION OF THE INVENTION

Figure 1:
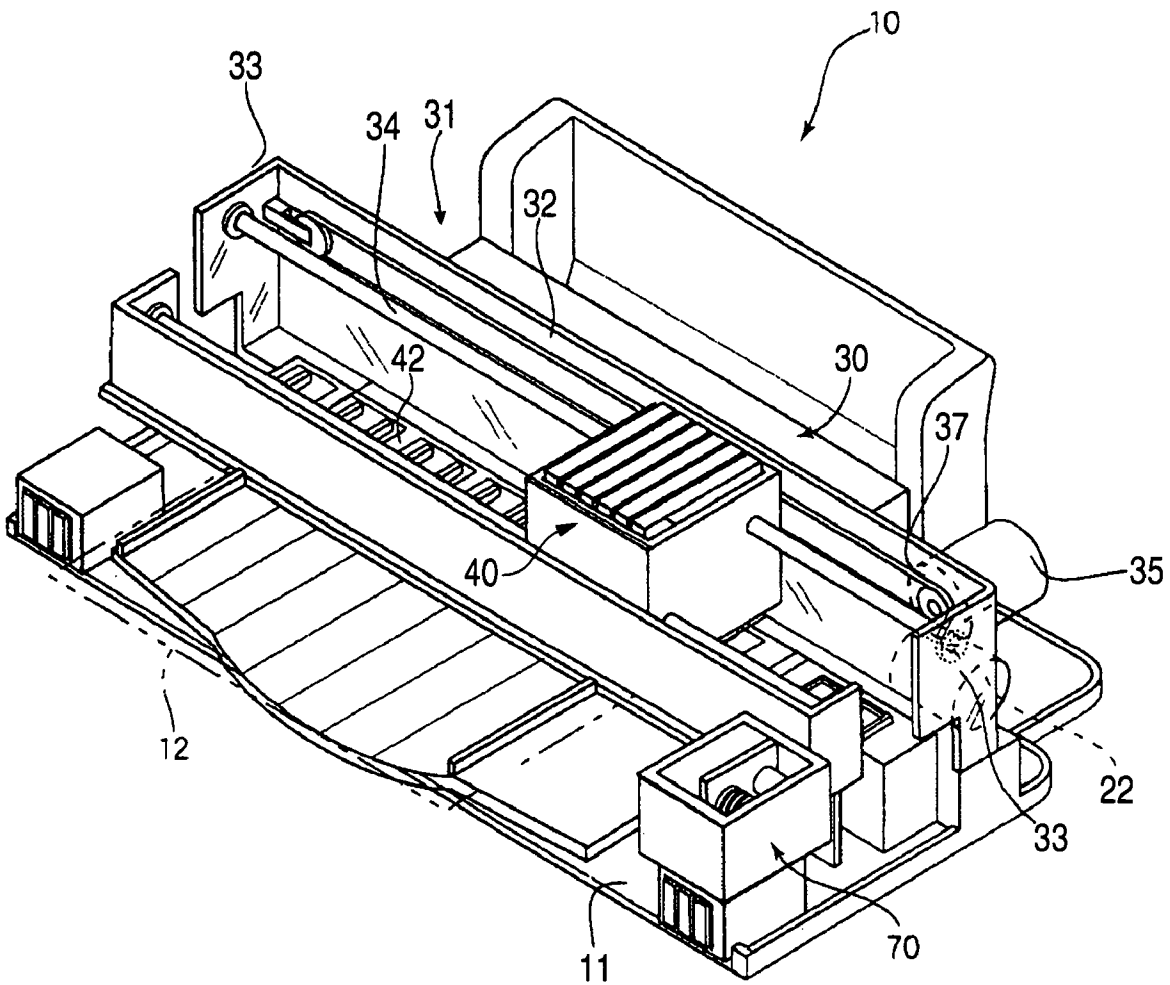
FIG. 1 is a perspective view showing the construction of a printer according to an embodiment of the present invention.

An embodiment of a printer to which the pump control mechanism according to the present invention is applied will be described with reference to FIG. 1 to FIG. 15. The printer 10 of this embodiment is an ink jet type printer, and the ink jet type printer may be a device adopting any jetting method insofar as the device can perform printing by jetting ink.

In the following description, the lower side indicates the mount face 1 side on which the printer 10 is mounted, and the upper side indicates the side spaced from the mount face 1. Furthermore, a direction along which a carriage 40 described later moves is defined as a main scanning direction, and a direction that is perpendicular to the main scanning direction and along which a print target 12 is fed is defined as an auxiliary scan direction. Furthermore, a side from which the print target 12 is supplied (the upstream side of sheet feeding) is defined as a back side, and a side from which the print target 12 is discharged (the downstream side of sheet feeding) is defined as a front side. The description will be made on the basis of the above definition.

The printer 10 is equipped with a chassis 11 in contact with the mount face 1, and various kinds of units are mounted on the chassis 11. Various kinds of units contain a sheet feeding mechanism 20 for feeding the print target 12 by a sheet feeding motor (PF motor 22), a carriage mechanism 30 for reciprocating the carriage 40 in the axial direction of a sheet feeding roller by a carriage motor (CR motor 35), a cartridge mount portion 60 on which a cartridge 62 having ink stored therein is mounted, a pump unit 70 for feeding air into the cartridge 62 and pressurizing the air, etc., and further a controller 90 shown in FIG. 2 and FIG. 6 exists.

Figure 2:
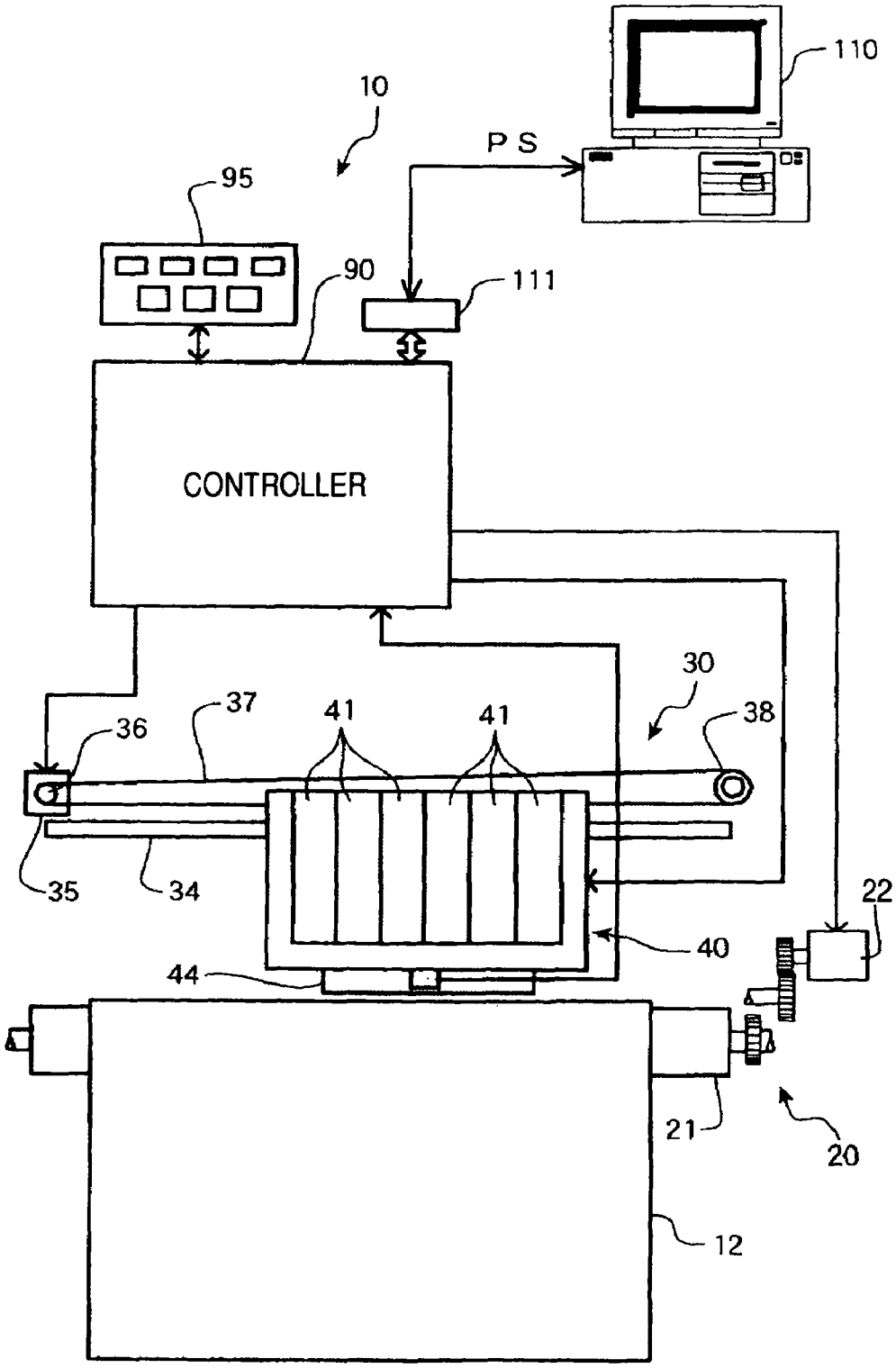
FIG. 2 is a diagram showing the construction of the printer.

As shown in FIG. 2, the sheet feeding mechanism 20 is equipped with respective rollers such as a sheet roller (not shown), a feeding roller 21, etc., and also equipped with a sheet feeding motor (PF motor 22) for driving these rollers. The driving force of the PF motor 22 is transmitted through a transmission mechanism comprising plural gears, etc.

The carriage mechanism 30 shown in FIG. 1, FIG. 2, etc. is equipped with the carriage 40, and further equipped with a support frame 31, a carriage shaft 34 that is supported by the support frame 31 and holds the carriage 40 so that the carriage 40 is slidable, a carriage motor (CR motor 35) disposed at the back side of a shielding plate portion 32 described later, a gear pulley 36 secured to the CR motor 35, an endless belt 37, and a driven pulley 38 for applying tension to the endless belt with the gear pulley 36.

As shown in FIG. 1, the support frame 31 comprises a shielding plate portion 32, and side plate portions 33 that are bent toward the sheet discharge side at both the end sides of the shielding plate portion 32. Carriage shafts 34 for guiding the sliding of the carriage 40 along the longitudinal direction of the chassis 11 are supported in the pair of side plate portions 33. Furthermore, a CR motor 35 for driving the gear pulley 36 is provided at the back side of the shielding plate portion 32.

The gear pulley 36 is secured to the rotational shaft of the CR motor 35 at the back side of the shielding plate portion 32. A platen 42 is provided at a site of the chassis 11 at the front side from the support frame 31 (shielding plate portion 32). The platen 42 is secured so that the longitudinal direction thereof is along the longitudinal direction of the chassis 11. The upper surface of the platen 42 serves as a sheet feeding face for feeding a print target 12. The object fed on the upper surface of the platen 42 is not limited to the print target 12, but a separate feeding tray or the like for holding the print target 12 may be used.

Furthermore, the carriage 40 is provided so as to confront the platen 42. In the carriage 40 can be mounted liquid containers 41 the number of which is equal to the number of colors (six colors in FIG. 2) of the cartridge 62 described later. One end side of a liquid pipe line 43 such as a flexible tube or the like is connected to each liquid container 41 as container. Each color of cartridge 62 is supplied to each liquid container 41. The present invention is not limited to the construction that the same number of the liquid containers 41 as the number of the colors of the cartridge 62 exist. For example, when the inside of the liquid container 41 is partitioned without leakage, the number of the liquid containers 41 can be reduced to be smaller than the number of the colors of the cartridge 62.

As shown in FIG. 2, a print head unit 44 having a print head 45 (see FIG. 4) is provided below the carriage 40 so as to project toward the platen 42 side. Furthermore, many nozzles 45*a* are formed at the lower end side of the print head 45. Ink supplied from the liquid container 41 is jetted as an ink droplet from the nozzle 45*a* to the print target 12. An external case (not shown (is secured to the chassis 11. The external case covers each mechanism of he printer 10, and protect these mechanism from impact, dust, etc.

As shown in FIG. 1, the chassis 11 is provided with a cartridge mount portion 60, and the cartridge mount portion 60 is provided at one end side and the other end side in the main scan direction of the chassis 11, and also provided at the front side of the chassis 11. The cartridge mount portion 60 is provided with a housing 61 in which the cartridges 62 are mounted. In this embodiment, for example, six colors of K (black), LM (light magenta), LC (light cyan), C (cyan), M (magenta) and Y (yellow) of cartridges 62 exist as the liquid supply sources.

Figure 4:
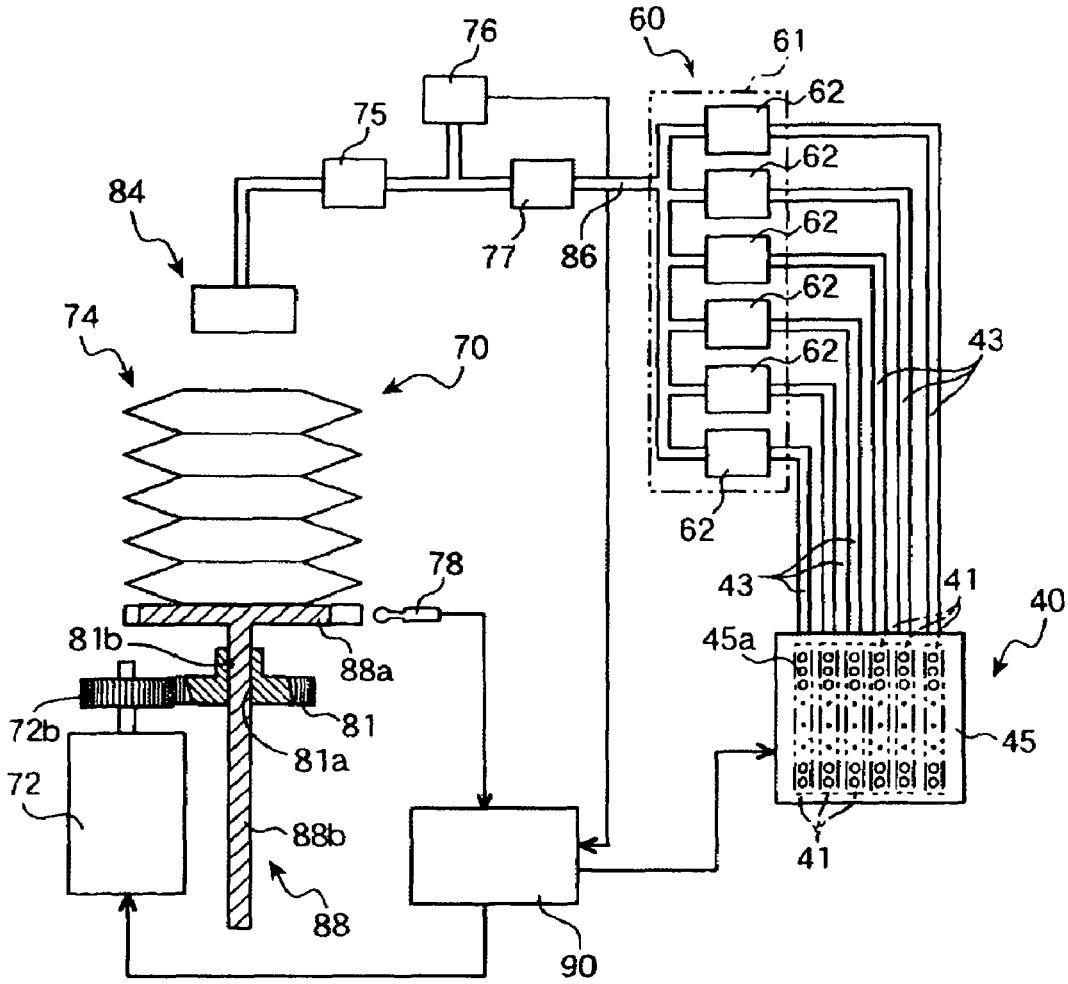
FIG. 4 is a diagram showing the pump unit under expansion state and elements related to pressurization.
Figure 5:
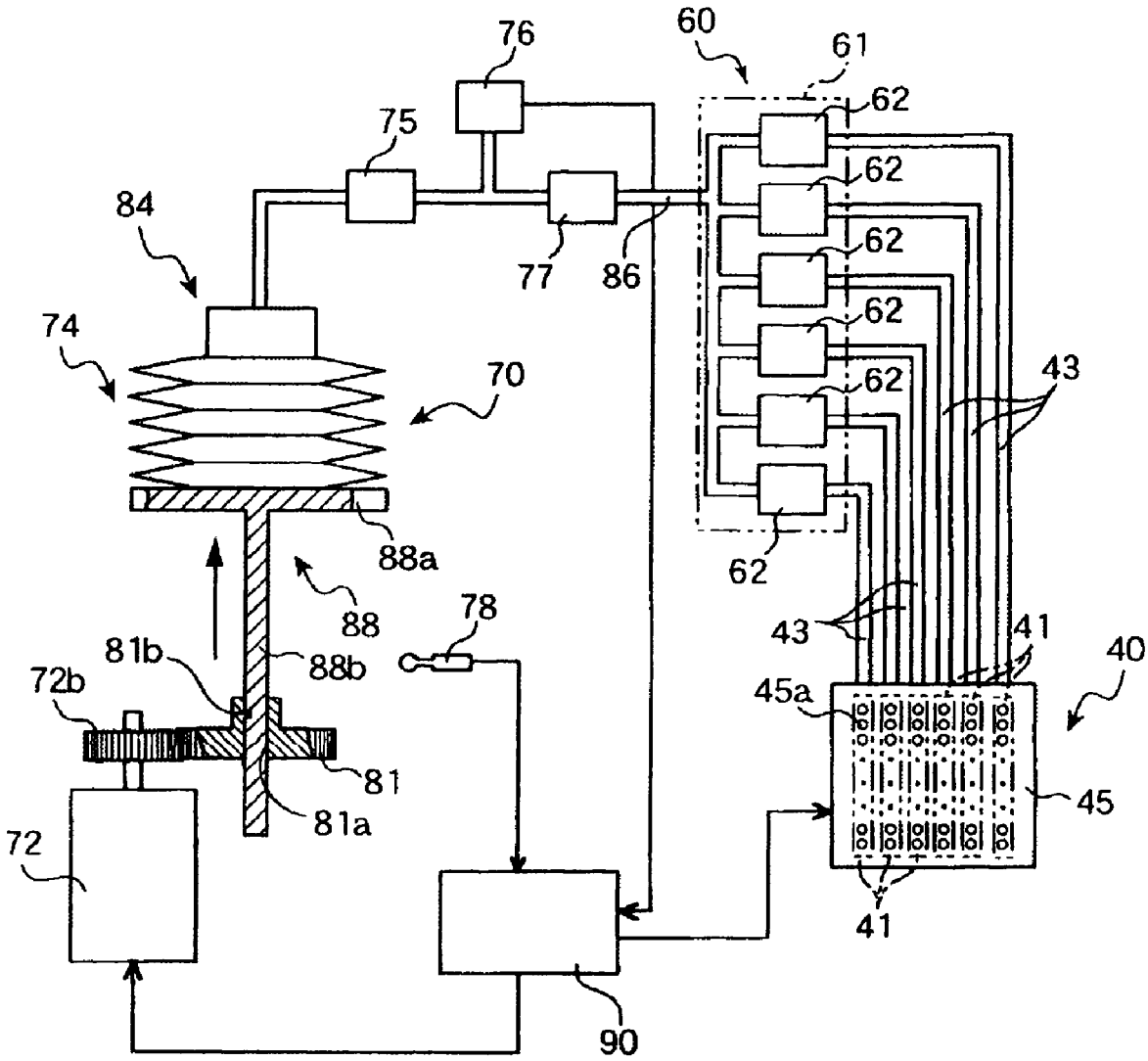
FIG. 5 is a diagram showing the pump unit under contraction state and the elements related to pressurization.

As shown in FIGS. 4 and 5, one end side of an air pipe line 86 is connected to the housing 61. Air supplied through the air pipe line 86 is distributed to each cartridge 62. Accordingly, ink existing in each cartridge 62 is fed through the liquid pipe line 43 into the liquid container 41 by the pressure of the air. Liquid pipe lines 43 whose number corresponds to the number of the colors of the cartridges 62 are connected to the housing 61. The liquid pipe line 43 receives the air pressure as described above to conduct the ink existing in the cartridge 62 to the liquid container 41.

Figure 3:
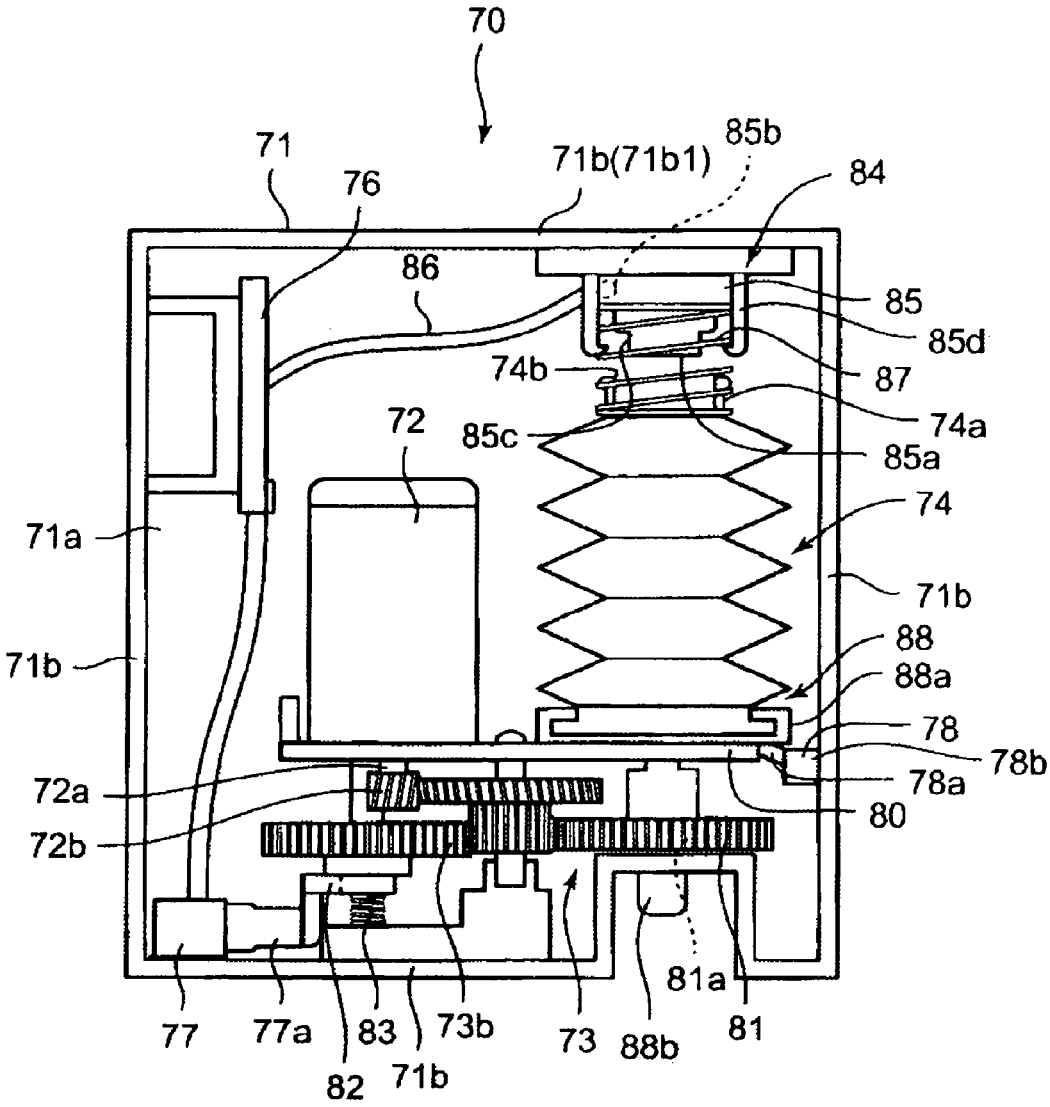
FIG. 3 is a plan view showing the mechanical construction of the pump unit.

As shown in FIG. 1, the chassis 11 is provided with a pump unit 70. The pump unit 70 is provided to a site of the chassis 11 which does not interfere with the carriage mechanism 30 (for example, at the front side and one end side of the chassis 1). As shown in FIG. 3, the pump unit 70 mainly comprises a casing 71, a pump motor 72, a gear train 73, a bellows pump 74, a check valve 75 (see FIG. 4), a pressure sensor 76, a regulator 77 and a position detecting sensor 78.

The casing 71 is designed in such a box shape that the lower and side portions thereof are covered by a bottom wall 71*a* and four outer walls 71*b* and the upper portion thereof is opened. The casing 71 is a member to which each member of the pump unit 70 is secured and which is mounted on the chassis 11. A support plate 80 is erectly provided in the casing 71 so as to be substantially parallel to the outer wall 71*b*1.

Furthermore, a pump motor 72 having a driving gear 72*b* at the rotational shaft 72*a* thereof and corresponding to the motor is secured to the support plate 80. The pump motor 72 is a CD motor adapted to PWM (Pulse Width Modulation) control, and rotates an output gear 81 with power from a pump motor driving circuit described later. Furthermore, the gear train 73 comprising plural driven gears is disposed in the casing 71. The output gear 81 is engaged with the gear train 73. The gear train 73 transmits the driving force generated in the pump motor 72 while decelerating and rotating. The output gear 81 is provided with a through hole 81*a* penetrating through the center in the radial direction, and a guide shaft 88*b* described later is inserted though the through hole 81*a*.

A rotating lever 82 is coaxially provided to the second gear 73*b* of the gear train 73. The rotating lever 82 is urged to the second gear 73*b* by a spring 83. This urging force forces the rotating lever 82 to rotate in synchronism with the second gear 73*b*. Here, when the rotating lever 82 is reversely rotated, it is allowed to be engaged with a projecting piece 77*a* of the regulator 77. Therefore, when the second gear 73*b* is reversely rotated, the rotating lever 82 collides against the projecting piece 77*a* of the rotating lever 82, so that the projecting piece 77*a* is allowed to be pressed down.

A bellows pump 74 is secured as a pump member between the support plate 80 and the outer wall 71*b*1 described above. The bellows pump 74 is a cylindrical member having the bellows-shape, and formed of flexible resin or the like. A small-diameter portion 74*a* smaller in diameter than the other portions is provided at one end side of the bellows pump 74. The end face of the small-diameter portion 74*a* at the one end side is designed to be opened and serve as an opening portion, so that air can be taken into the bellows pump 74. In this embodiment, the other end side of the bellows pump 74 is not opened.

The one end side of the bellows pump 74 at which the opening portion 74*b* exists is fixedly supported by a one-end holding member 84, and the one-end holding member 84 is secured to the outer wall 71*b*1. The one-end holding member 84 is equipped with an air leading portion 85 projecting to the other end side (the support plate 80 side) of the bellows pump 74. The air leading portion 85 is a portion into which air is fed by the expansion operation of the bellows pump 74. Therefore, the air leading portion 85 is equipped with an air taken-in port 85*a* into which air is fed by the bellows pump 74.

The air leading portion 85 is provided with an air discharge port 85*b*, and one end side of the air pipe line 86 is secured to the air discharge port 85*b*. The other end side of the air pipe line 86 is connected to the cartridge 62 to feed air to the cartridge 62. Furthermore, the air leading portion 85 is provided with a fitting portion 85*c* which is intruded from the opening portion 74*b* into the bellows pump 74. When the fitting portion 85*c* is intruded into the bellows pump 74 and fitted therein, the air in the bellows pump 74 can be prevented from leaking even when the bellows pump 74 is contracted.

Furthermore, a spring 87 is provided between the air leading portion 85 and one end side of the bellows pump 74, and the spring 87 is provided so that the spring 87 does drop off by a spring fixing pawl 85*d* of the air leading portion 85. Furthermore, the spring 87 is provided to the outer peripheral side of the fixing portion 85*c* to apply urging force so that one end side (opening portion side) of the bellows pump 74 is urged to the other end side of the bellows pump 74. Therefore, when the bellows pump 74 is under the expansion state, the one end side of the bellows pump 74 is urged to the other end side by the urging force of the spring 87, so that the opening portion 74*b* is separated from the fixing portion 85*c*. Accordingly, when the bellows pump 74 is under the expansion state, air can be taken into the bellows pump 74.

In the process that the bellows pump 74 is being shifted to the contraction state, the opening portion 74*b* is fitted to the fixing portion 85*c* to set such a state that the air taken in the bellows pump 74 can be prevented from leaking to the outside. Thereafter, when the bellows pump 74 is contracted, the air in the bellows pump 74 is pushed out from the bellows pump 74 to the air pipe line 86, and the air pressure caused by the push-out of the air acts on the inside of the cartridge 62 through the air pipe line 86.

A check valve 75 (see FIG. 4) is provided at some midpoint of the air pipe line 86 so that backflow of air directing from the bellows pump 74 to the cartridge 62 can be prevented and the pressure can be kept. The check valve 75 may be provided to some midpoint portion of the air pipe line 86, however, it may be contained in the one-end holding member 84.

Furthermore, an other-end holding member 88 is provided to the other end side of the bellows pump 74. The other-end holding member 88 has an other-end receiving portion 88*a* and a guide shaft 88*b*, and both the parts concerned are provided integrally with each other. The other-end receiving portion 88*a* fixedly receives the other end side of the bellows pump 74. The guide shaft 88*b* is inset in the through hole 81*a* of the output gear 81 described above so as to be freely insertable through the through hole 81*a*.

Figure 7:
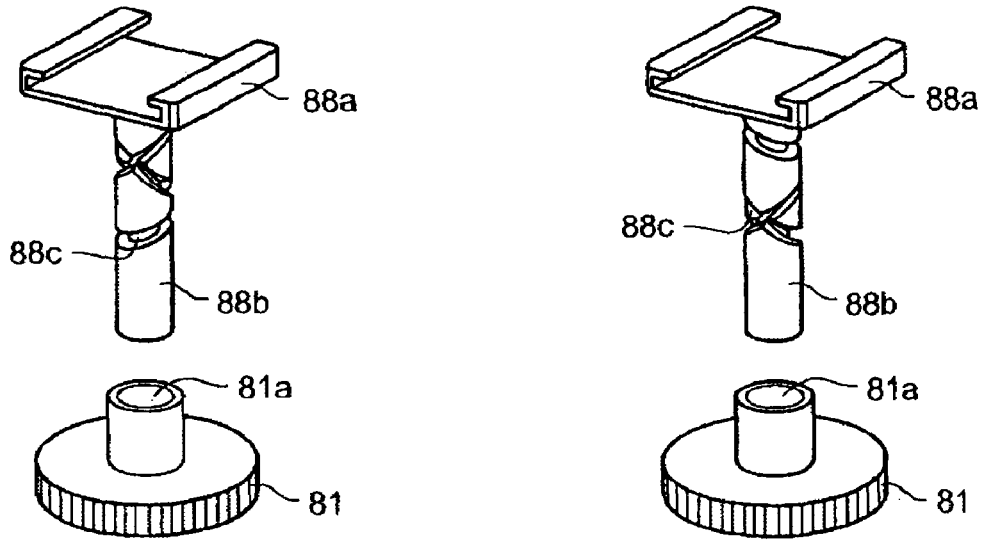
FIG. 7 is an exploded perspective view showing the construction of an other-end holding member and an output gear.

Furthermore, as shown in FIG. 7, a spiral groove 88*c* is formed on the guide shaft 88*b*. A fitting projection 81*b* projecting from the inner wall surface of the through hole 81*a* is put into the spiral groove 88*c*. Therefore, when the fitting projecting 81*b* is rotated in connection with the output gear 81, the guide shaft 88*b* is pushed by the fitting projection 81*b*, and reciprocates along the axial line direction of the bellows pump 74. As described above, the expansion and contraction of the bellows pump 74 can be executed. When the output gear 81 is rotated in one-way direction, the spiral groove 88*c* draws a closed loop for reciprocating the other-end holding member 88.

A pressure sensor 76 is secured to the casing 71. the pressure sensor 76 is a reflection type sensor having a light emitting element and a photodetecting element, and it has a lid member (not shown) and a thin film member such as cellophane or the like (not shown). When air pressure is applied to the thin film member, the thin film member is expanded. The expansion causes the thin film member to approach to the lid member. When the thin film member approaches to the lid member within a predetermined distance, light emitted from the light emitting element can be detected by the photodetecting element, and an H signal (corresponding to a pressure detecting signal) is transmitted, whereby the pressure is detected.

Air passing through the pressure sensor 76 is fed into a regulator 77. The regulator 77 is equipped with a projecting piece 77*a*. When the projecting piece 77*a* is downwardly pressed by the rotating lever 82, the regulator 77 releases the pressure. Furthermore, when predetermined pressure or more is imposed, the regulator 77 automatically releases the pressure.

When the second gear 73*b* is forwardly rotated, the rotating lever 82 moves to the upper side and the rotating lever 82 is not fitted to the projecting piece 77*a*. However, when the gear train 73 is reversely rotated, the rotating lever 82 is downwardly moved, the rotating lever 82 collides against the projecting piece 77*a* and pushes the projecting piece 77*a* downwardly. The switching of the projecting piece 77*a* can be performed as described above.

A position detecting sensor 78 serving as a part of the position detector is secured to the casing 71. The position detecting sensor 78 has a rotatable detecting lever 78*a*. The detecting lever 78*a* can abut against the other-end receiving portion 88*a*. The detecting lever 78*a* is projected from the main body 78*b* containing a switch for transmitting a High (H)/Low (L) signal, and the expansion position of the bellows pump 74 can be detected by switching the H/L switch. Here, when the bellows pump 74 is under the contraction state, the detecting lever 78*a* is not pressed in by the other-end receiving portion 88*a*, and located at one end side approaching to the bellows pump 74. However, when the bellows pump 74 is under the expansion state, the detecting lever 78*a* is pushed to the other end side by the movement of the other-end receiving portion 88*a*, and the signal is switched, whereby the expansion position of the bellows pump 74 can be detected.

In this embodiment, the positioning detecting sensor 78 is designed so that the H/L switching is carried out at the position where the bellows pump 74 expands at the maximum. Furthermore, in this embodiment, when the bellows pump 74 expands at the maximum and presses the detecting lever 78*a*, an H signal (corresponding to a position detection signal) is transmitted.

Figure 6:
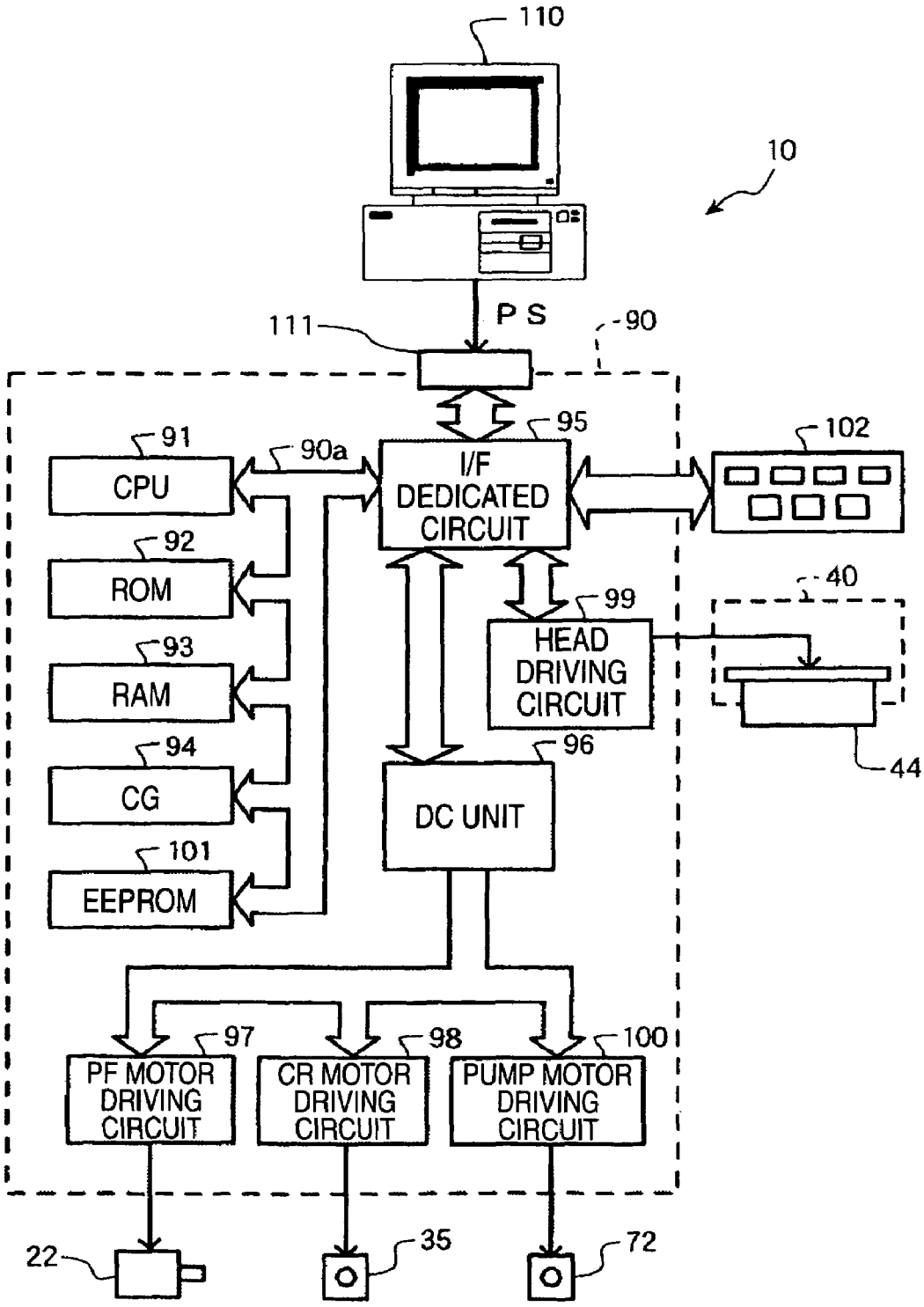
FIG. 6 is a block diagram showing a controller for carrying out various kinds of control of the printer.

Next, the construction of the controller 90 will be described with reference to FIG. 6, etc. The controller 90 is equipped with a bus 90*a*, CPU 91, ROM 92, RAM 93, a character generator (CG) 94, an I/F dedicated circuit 95, a DC unit 96, a PF motor driving circuit 97, a CR motor driving circuit 98, a head driving circuit 99, a pump motor driving circuit 100, a non-volatile memory 101, etc. The controller 90 functions as a part of the positioning detector, the driving information calculator, the correction information calculator and the corrector in cooperation with the above-described elements.

To CPU 91 and the DC unit 96 are input respective output signals of various kinds of sensors (not shown), etc. (a rotary encoder for detecting the rotational amount of the feeding roller 21, a linear encoder for detecting the moving amount of the carriage 40, a sheet detecting sensor for detecting the start end and terminal of the print target 12, a PW sensor for detecting the length (width) of the print target 12 in the auxiliary scan direction, a power SW for turning on/off the power source of the printer 10, etc.).

CPU 91 carries out the operation processing for executing a control program for the printer 10 which is stored in ROM 92, a non-volatile memory 101 or the like, and other necessary operation processing.

In ROM 92 are stored a control program for controlling the ink jet printer 10, data necessary for execute the processing, etc. In this embodiment, an initial value of target information which is a target driving speed of the pump motor 72 is stored in ROM 92. Furthermore, In ROM 92 is stored a control table for the Duty ratio of the voltage applied to the pump motor 72 (an initial value as an outline of the control table. Therefore, ROM 92 functions as information memory. However, the target information and the control table may be stored in non-volatile memory 101 in advance.

Figure 8:
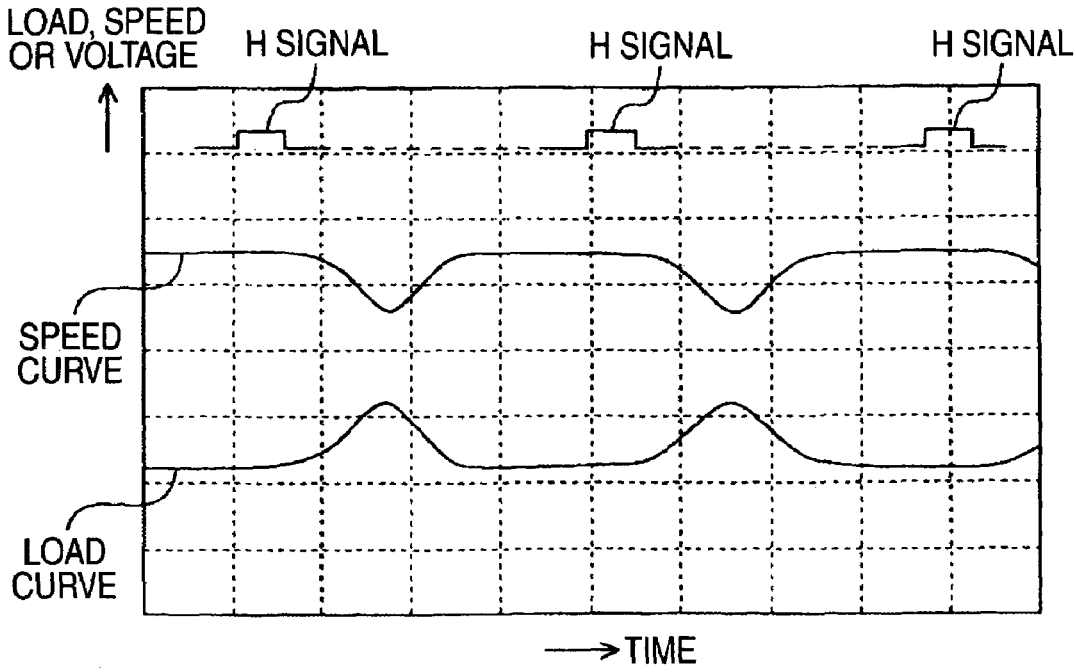
FIG. 8 is a diagram showing the relationship between the load and the speed when the Duty ratio is fixed.

Here, the control table will be described with reference to FIGS. 8 to 10. When the Duty ratio of the voltage is fixed within one cycle from the detection of an H signal by the position detecting sensor 78 till the detection of the next H signal, the relationship between the load and the speed of the pump motor 72 is briefly shown in FIG. 8. FIG. 8 is a diagram schematically showing only a load curve, a speed curve and the waveform of the H signal detection, and the description of unit is omitted.

In FIG. 8, after the H signal is first detected, the load of the bellows pump 74 is highest slightly before the bellows pump 74 is most contracted. Therefore, at this portion, the speed of the pump motor 72 is lowest. However, at the site where the curve indicating the load is substantially flat at the lower side, the speed of the pump motor 7 is high because the load is light. Therefore, the relationship between the load acting on the pump motor 72 and the driving speed of the pump motor 72 is substantially symmetrical with respect to a line parallel to the time axis.

Within the one cycle described above, when a speed variation of the pump motor 72 (bellows pump 74) as shown in FIG. 8 occurs, beat of noise occurs due to the speed variation. Therefore, in order to prevent occurrence of the beat of noise, the Duty ratio of the voltage is varied within one cycle to reduce the variation width of the speed of the pump motor 72.

First Embodiment

A first embodiment of the invention will be described below.

Figure 9:
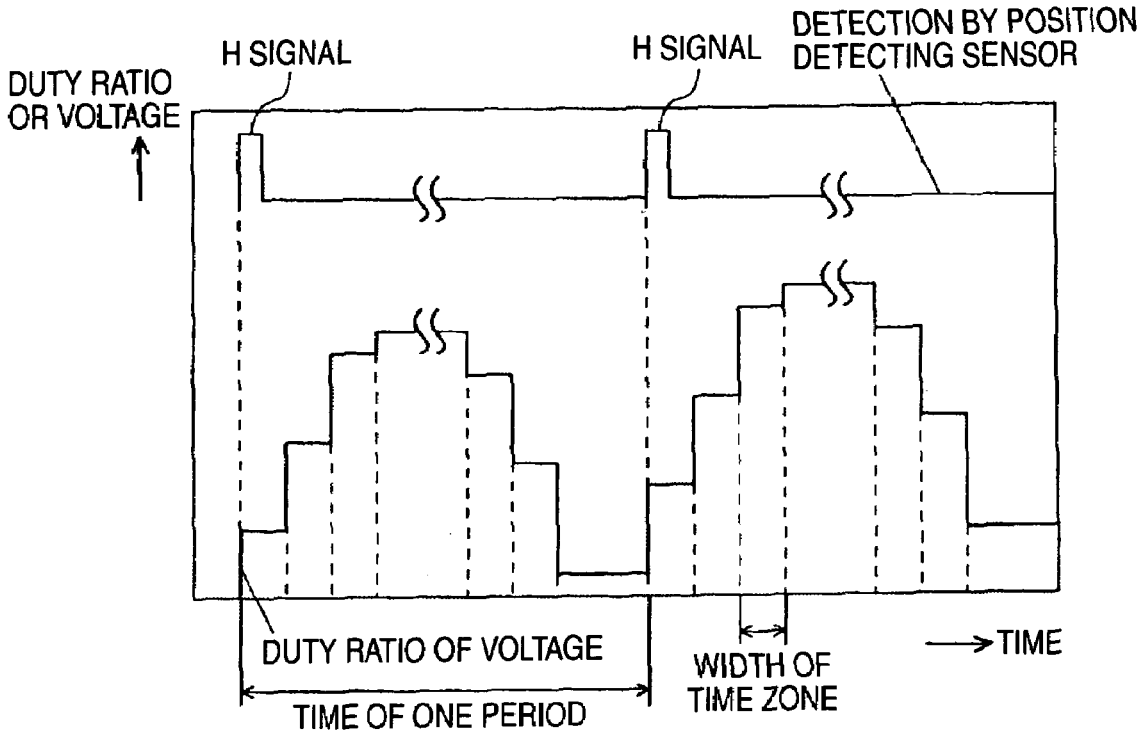
FIG. 9 is a diagram showing an example in which the Duty ratio within one cycle is varied.
Figure 10:
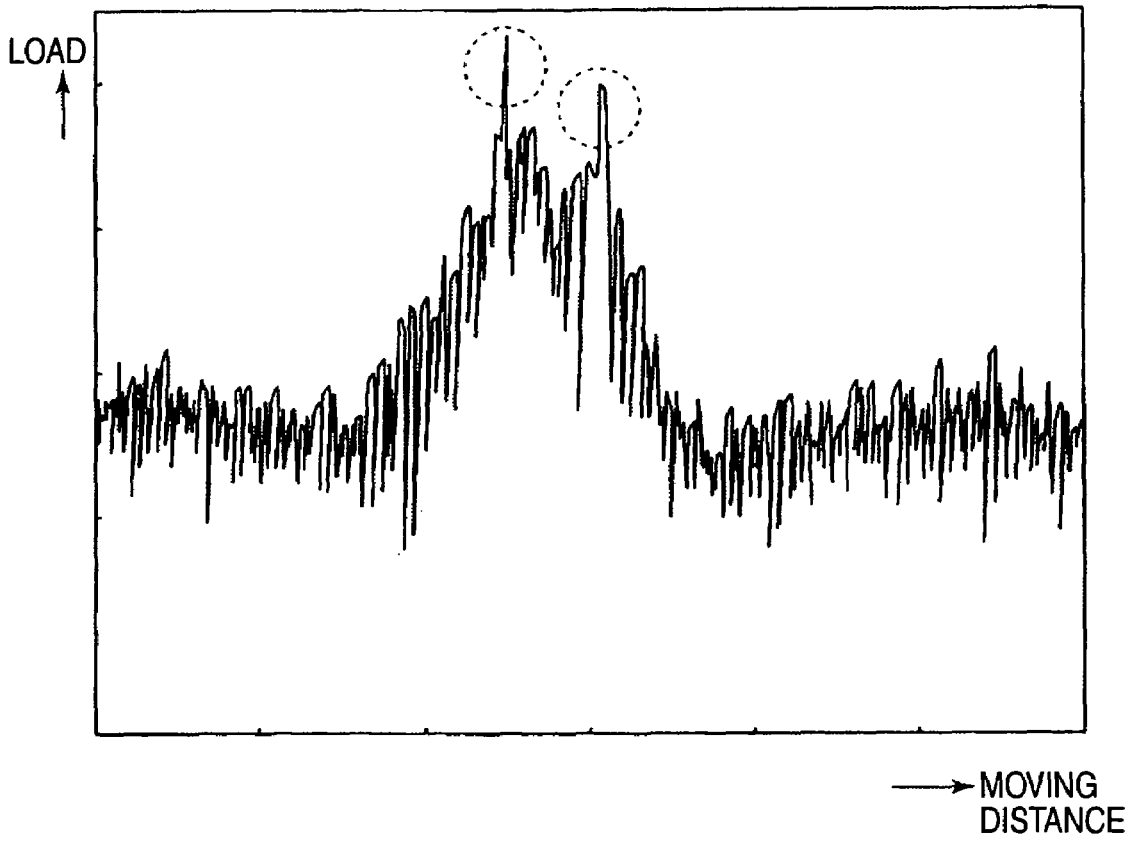
FIG. 10 is a diagram showing the relationship between the load and the moving distance of an other-end receiving portion, etc.

FIG. 9 shows a graph of the Duty ratio of the voltage of the first embodiment. FIG. 9 is a diagram showing only the waveforms of the Duty ratio and the H signal detection, and the description of the unit is omitted. As shown in FIG. 9, one cycle is divided into N parts such as 20 parts. In each segmentalized time zone, the speed of the pump motor 72 at the load-peak portion in FIG. 8 is set as a reference (this speed will be hereinafter referred to as "reference speed"), and the Duty ratio in each time zone is adjusted so that the speed approaches to the reference speed. The variation of the driving speed of the pump motor within one cycle can be suppressed to a small level or substantially fixed, so that no beat occurs.

As described above, the schematic control profile of the Duty ratio is achieved. However, the actually measured load varies minutely in the vertical direction. This aspect is shown in FIG. 10. FIG. 10 is a graph showing the measurement result of a load acting on the pump motor 72, wherein the ordinate axis represents the magnitude of the load and the abscissa axis represents the moving distance in the reciprocating motion of the other-end receiving portion 88*a*, etc. As shown in FIG. 10, a locally large portion (corresponding to a portion surrounded by a broken line of FIG. 10) exists in the load which actually acts on the pump motor 72. Therefore, there is a case where the pump motor 72 cannot override the local load-large portion, and thus the pump motor 72 is stopped.

Figure 11:
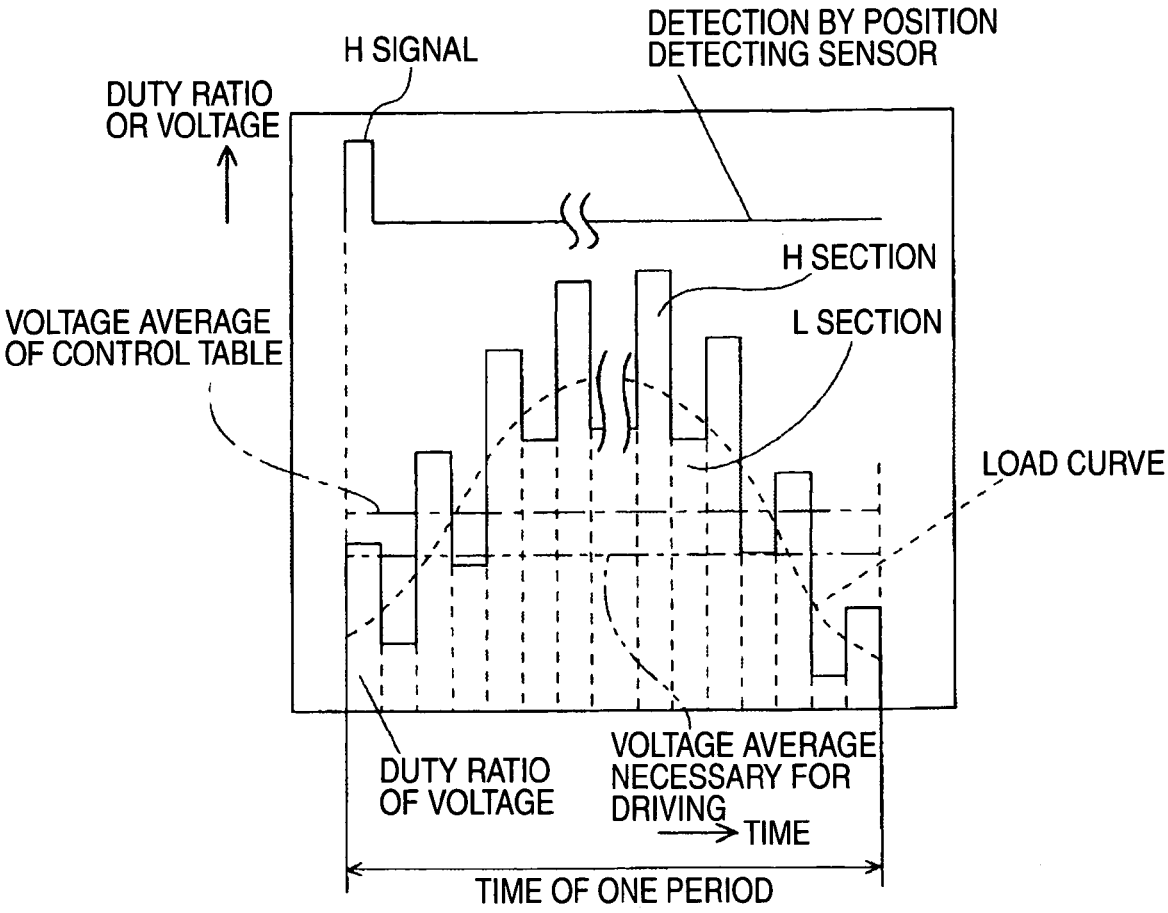
FIG. 11 is a diagram showing an example of a control table in which an H section and an L section exist according to a first embodiment.

The control table is set to a state shown in FIG. 11 in connection with occurrence of the local load-large portion as described above. In the profile of the control table shown in FIG. 11, the time zone section in which the Duty ratio is increased (corresponding to the control information increasing section; hereinafter referred to as H section) and the time zone section in which the Duty ratio is reduced (corresponding to the control information reducing section; hereinafter referred to as L section) are repetitively arranged while being adjacent to each other. The H section is set (dispersed) in magnitude so that when a locally large load occurs, the pump motor 72 can overcome the load.

Here, the degree in dispersion in the vertical direction of the H section and the L section may be set in proportion to the Duty ratio, or increased/reduced by a fixed value with the profile (load curve) of the load at the center. In the measurement of the load of FIG. 10, the dispersion occurs irrespective of the load large portion/small portion. In this case, a method of increasing/reducing the dispersion by the fixed value is preferable.

Furthermore, the average value of the Duty ratio constructed the H section and L section is set to a larger value than the average value of the voltage calculated from the profile of the load. As described above, the average of the Duty ratio of the voltage as shown in FIG. 11 is set to a larger value than the average of the Duty ratio actually required to drive the pump motor 72, whereby the pump motor 72 can be surely driven.

The H section and the L section in the control profile may exist over the whole of one cycle, or exist in only a partial area of one cycle. As an example in which it exists in only a partial area, the H section and the L section may exist in only a portion where the load increases. Furthermore, not only a case where the H section and the L section alternately repeated, but also a case where each of the H section and the L section may be sequential at a predetermined number of times.

Furthermore, the H section and the L section exist in the control profile described above, however, the control profile may be set so that only the H section exists therein. In this case, the pump motor 72 can also overcome a locally occurring large load, so that the pump motor 72 can be prevented from being stopped. When only the H section is provided, the H section may be provided every fixed time zone section, or the interval of the time zone sections to which the H section is provided may be suitably dispersed.

Second Embodiment

A second embodiment of the invention will be described below.

Figure 12:
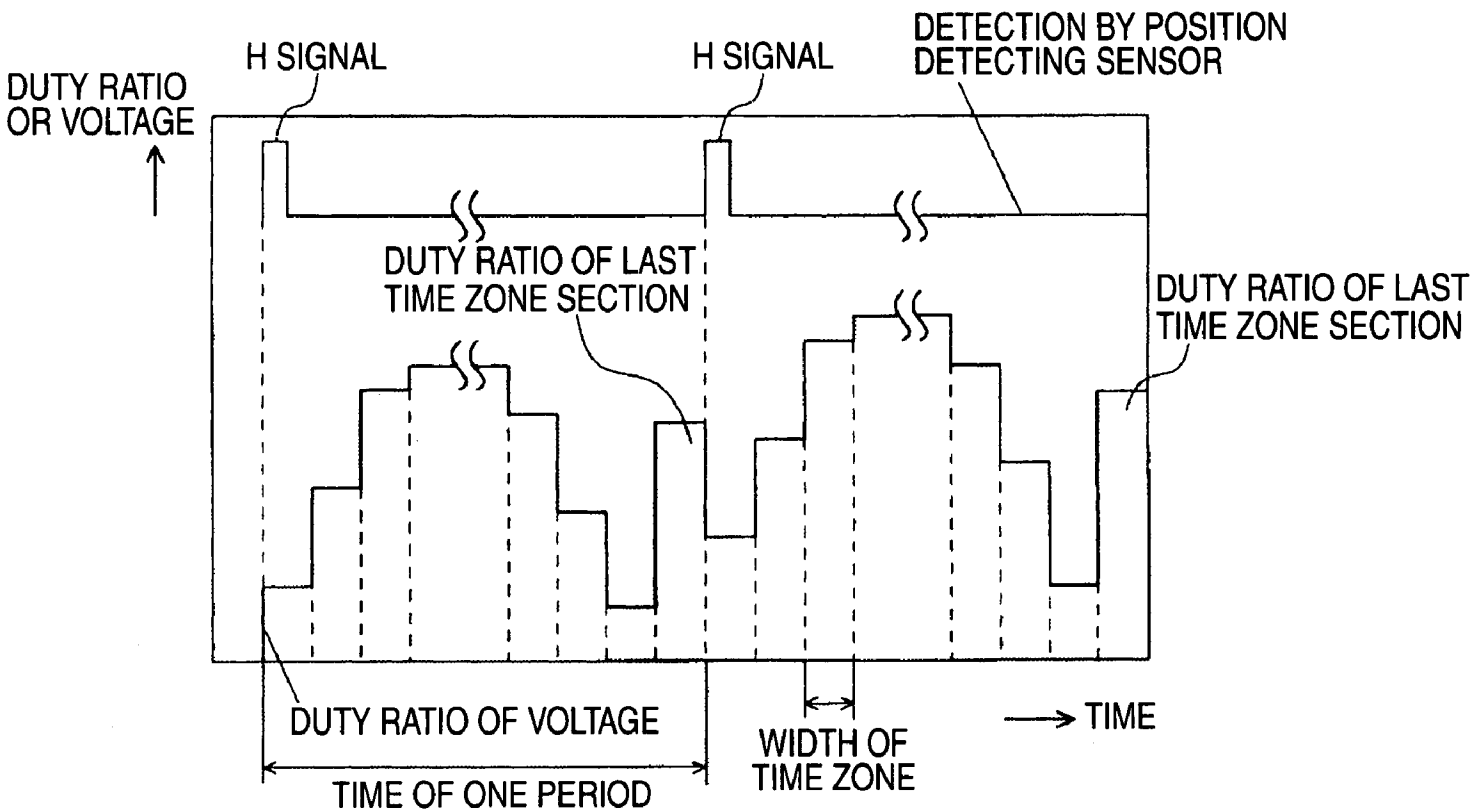
FIG. 12 is a diagram showing an example in which the Duty ratio within one cycle is varied.

FIG. 12 shows a graph of the Duty ratio of the voltage. FIG. 12 is a diagram showing only the waveforms of the Duty ratio and the H signal detection, and the description of the unit is omitted. As shown in FIG. 12, one cycle is divided into N parts such as 20 parts. In each segmentalized time zone, the speed of the pump motor 72 at the load-peak portion in FIG. 8 is set as a reference (this speed will be hereinafter referred to as "reference speed"), and the Duty ratio in each time zone is adjusted so that the speed approaches to the reference speed. The variation of the driving speed of the pump motor within one cycle can be suppressed to a small level or substantially fixed, so that no beat occurs.

Here, with respect to each Duty ratio in the segmentalized time zone shown in FIG. 12, the Duty ratio in the last time zone of one cycle (corresponds to the last portion; hereinafter referred to as "last section") is set to be higher than the average Duty ratio of the cycle concerned (hereinafter referred to as "average Duty ratio"). In this case, the value of the Duty ratio of the last section is set to a sufficiently high value than an assumed load. Therefore, in the last section, the voltage of the Duty ratio higher than the average Duty ratio is applied to the pump motor 72.

The Duty ratio of the last section is not limited to the case where it is set to be higher than the average Duty ratio. For example, the Duty ratio of the last section may be set to a value that is higher than Duty ratio at the movement-start time (corresponding to the initial portion) of one cycle and lower than the average Duty ratio.

As described above, a schematic control profile of Duty ratio is achieved. However, an actually-measured load is minutely varied in the vertical direction. That is, locally intensified portion/weakened portion exist in the actual load acting on the pump motor 72. Therefore, there may occur such a case that the pump motor 72 cannot override the portion at which the load is locally intensified, and thus the pump motor 72 falls into the stop state.

Figure 13:
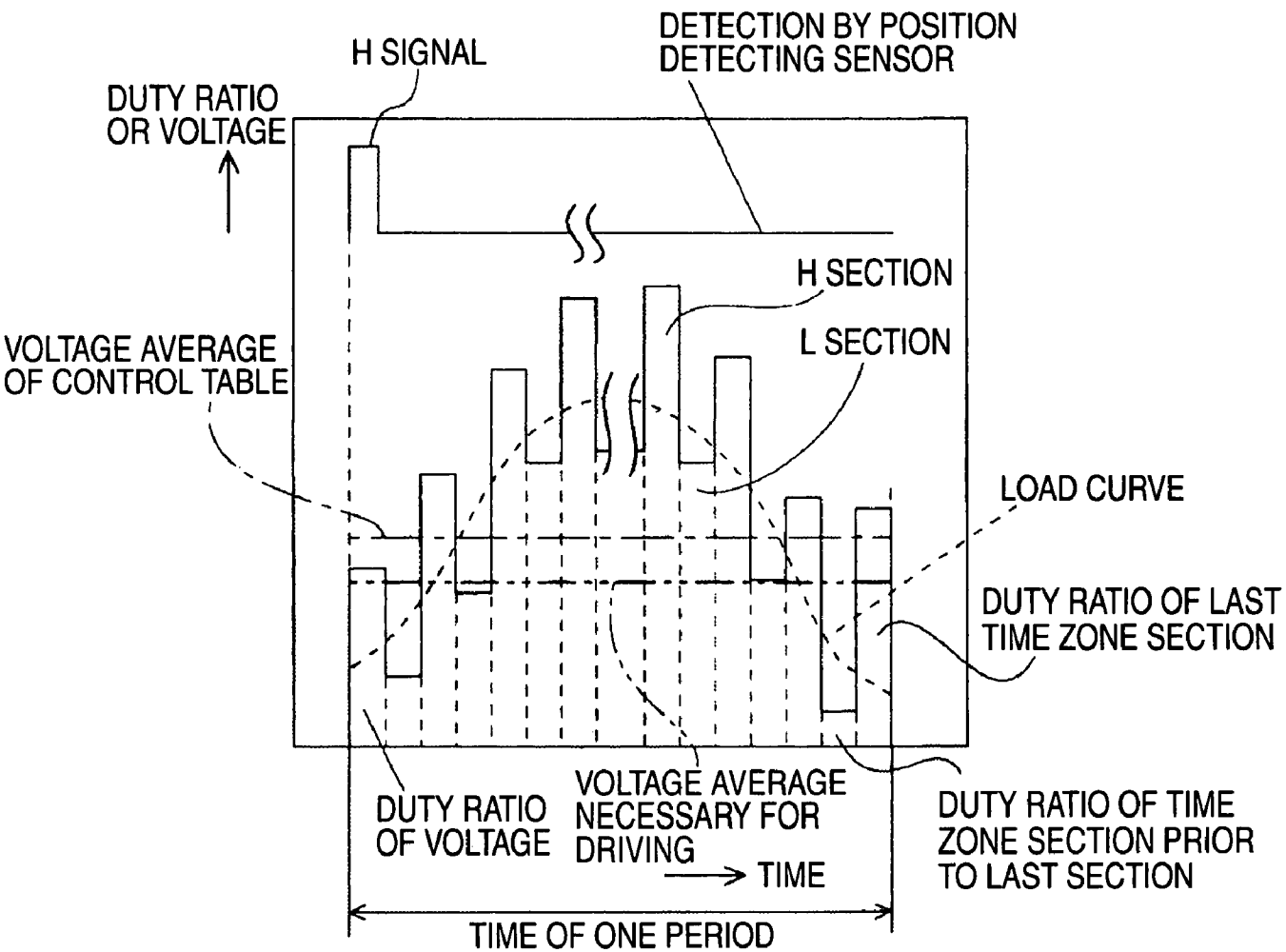
FIG. 13 is a diagram showing an example of a control table in which an H section and an L section exist according to a second embodiment.

Therefore, the control table is set to a state shown in FIG. 13. With respect to the control table shown in FIG. 13, the time zone section in which the Duty ratio is increased (corresponding to the control information increasing section; hereinafter referred to as "H section") and the time zone section in which the Duty ratio is reduced (corresponding to the control information reducing section; hereinafter referred to as "L section") are repetitively arranged while being adjacent to each other. In the H section, when a locally large load occurs, the load concerned is set to such a value that the pump motor 72 can override and thus drive (fluctuated).

In the profile shown in FIG. 13, the Duty ratio of the voltage in the last section is set to the H section, and in addition, the peak of the H section is set to be larger than the average value of the Duty ratio of the control profile. Therefore, if the Duty ratio of the last section is applied to the pump motor 72, the pump motor 72 could override even when a large load acts on the pump motor 72 at the last portion. Here, the dispersion degree in the vertical direction of the H section and the L section may be set to be proportional to the magnitude of the Duty ratio, or set to be increased/reduced by a fixed value with the profile of the load (load curve) as the center.

Furthermore, as shown in FIG. 13, the average value of the Duty ratio constructed by the H section and the L section is set to be larger than the average value of the voltage calculated on the basis of the load profile, whereby the pump motor 72 can be surely driven.

Furthermore, when it is assumed that the driving speed of the pump motor 72 driven on the basis of the control profile shown in FIG. 13 exceeds a fixed threshold value, the Duty ratio of the time zone section just prior to the last section (hereinafter referred to as "before-last section") corresponds to the L section, and it is set to be smaller than the average value of the Duty ratio of the control profile. In addition, it is set to be smaller than the Duty ratio at the start time (movement-starting time). As described above, since the Duty ratio of the before-last section exists, the driving speed of the pump motor 72 can be reduced when the driving speed exceeds a threshold value, excessively high or the like. That is, the driving speed can be reduced because the Duty ratio of the before-last section is low.

The Duty ratio of the before-last section is not required to be the L section. That is, the Duty ratio of the before-last section may be increased as in the case of the last section. Furthermore, the H section, the L section may be exist over the whole of one cycle of the control profile, or may exist in a partial area within one cycle. As an example that it exists in a partial area, the H section, the L section may exist at only a portion where the load increases. Furthermore, not only the H section and the L section are alternately repeated, but also each of the H section and the L section may be continued at plural times.

Furthermore, the above-described control profile may be set so that only the H section is provided. In this case, the pump motor 72 can overcome the locally-large load and thus the pump motor 72 can be prevented from being stopped. When only the H section is provided, the H section may be provided to the last section while the other portions may be provided every fixed time zone section. The interval of the time zone sections in which the H section is provided may be set to be suitable dispersed.

In the first and second embodiments, the control table of the Duty ratio of the voltage is stored in ROM 92 in advance. The control table of the Duty ratio concerned may be determined on the basis of experiments or the like in advance. That is, the load variation as shown in FIG. 11 is determined for a specific initial rotational number in advance, and the Duty ratio may be more finely set while reflecting the load variation. In this case, it is preferable that the pump motor 72 is actually driven at the set Duty ratio and it is checked whether the speed variation is within a fixed range.

Furthermore, as described later, a correction amount $\alpha$1, a correction amount $\alpha$3 is added/subtracted to/from the control table shown in FIGS. 11 and 13. There may be adopted a method of equally adding/subtracting the correction amount $\alpha$1, the correction amount $\alpha$3 described later to/from each duty ratio of all the time zones, or a method of adding/subtracting proportionally when viewed from a reference speed or another target speed. Furthermore, there may be adopted of a method of individually calculating the correction amount $\alpha$1, the correction amount $\alpha$3 and adding/subtracting them from the duty ratio of each time zone.

Furthermore, in these embodiments, there exist three modes for driving the pump motor 72 as described later. Therefore, there exist the control programs of the printer 10 whose number corresponds to the number of the modes. The I/F dedicated circuit 95 contains a parallel interface circuit, and it can receive a print signal from a computer 110 through a connector 111.

RAM 93 is a memory for temporarily storing a program being executed by CPU 91, data under operation or the like. The non-volatile memory 101 is a memory for storing various kinds of data required to be held even after the power source of the ink jet printer 10 is turned out. As described later, the Duty ratio of the voltage when the driving of the pump motor 72 is stopped is also stored in the non-volatile memory 101. However, these control data, etc. may be stored in another storage area. Furthermore, when the correction amount $\alpha$1 is added to the control table stored in ROM 92, the control table after the addition is stored in the non-volatile memory 101.

The DC unit 96 is a control circuit for carrying out the speed control of the PF motor, the CR motor 35 which are DC motors. The DC unit 96 carries out various kinds of operations to carry out the speed control of the PF motor 22 and the CR motor 35 on the basis of a control instruction transmitted from CPU 91, an output signal of a rotary encoder, an output signal of a linear encoder and an output signal of a sheet detecting sensor (not shown), and transmits a motor control signal to a PF motor driving circuit 97 and a CR motor driving circuit 98 on the basis of the operation result.

Furthermore, the PF motor driving circuit 97 controls the driving of the PF motor 22 on the basis of the motor control signal from the DC unit 96. The PF motor 22 serves a driving force source for feeding the print target 12. Furthermore, the CR motor driving circuit 98 controls the driving of the CR motor 35 on the basis of the motor control signal from the DC unit 96. The PF motor 22 and the CR motor 35 can be positionally kept under the stop state.

The head driving circuit 99 controls the driving of a piezoelectric element existing in the print head 45 on the basis of a driving control signal from CPU 91. A pump motor driving circuit 100 controls the driving of the pump motor 72. The pump motor 72 is also a DC motor, and when a pulse voltage having a frequency optimal to the driving is applied to the pump motor 72, the driving control based on the PWM control can be easily performed.

Here, the PWM control is a system of adjusting the width of H of the pulse voltage applied to the DC motor (hereinafter referred to as the width of H in one cycle of the pulse voltage will be hereinafter referred to as "Duty ratio") on the basis of the PWM signal for switching the ON/OFF of the switching element, adjusting the average voltage of the pulse voltage and carrying out the driving control of the DC motor. The Duty ratio corresponds to the control information. The correction amount $\alpha 1$ corresponds to the correction information.

A method using equal-width pulses all the pulse widths thereof are equal to one another, and a method using unequal-width pulses whose pulse widths are varied are used for the PWM control, however, any pulse signal may be used. Any pulse signal may be used by variously adjusting and combining the Duty ratio of the voltage pulse and the cycle of the voltage pulse.

The respective constituent elements of the above-described controller 90 are connected to one another through a bus 90*a* as a signal line. CPU 91, ROM 92, RAM 93, CG 94, the I/F dedicated circuit 95, the non-volatile memory 101, etc. are mutually connected to one another through the bus 90*a*, whereby data communication can be performed among these elements.

The details of the control when the printer 10 is operated by using the construction as described above will be described hereunder. In this embodiment, the controller 90 can drive the pump motor 72 in three modes. Here, as the three modes, there are provided three types of modes, "quiet mode" which is the quietest mode, "intermediate mode" which is quiet to some degree, and also pays attention to speed, and "speed mode" which pays no attention to noise, but pays attention to speed. In the following description, out of these three modes, the most quiet "quiet mode" for suppressing noise occurring from the pump unit 70 will be described.

(a) When the Pump Motor 72 is First Driven

Figure 14:
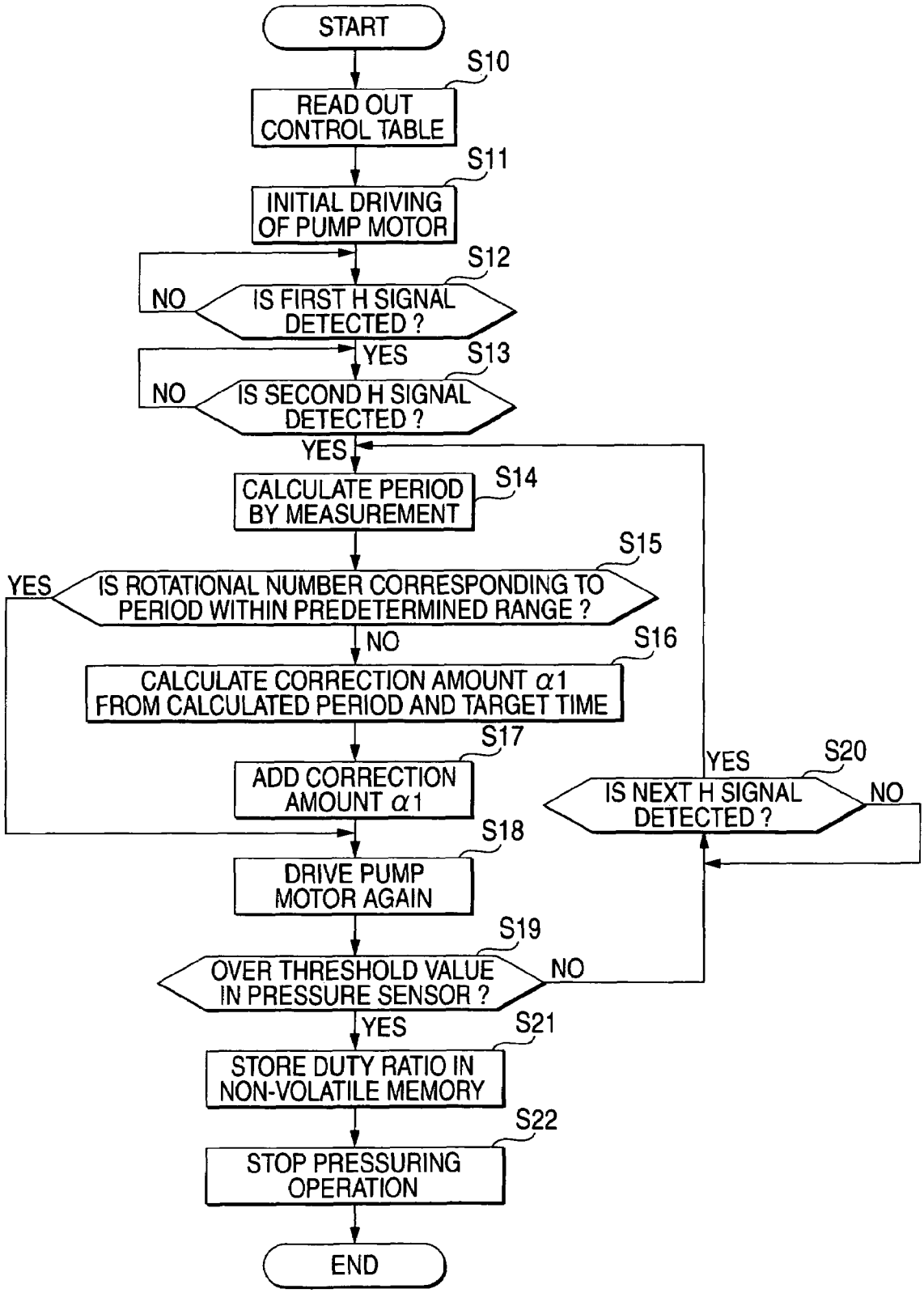
FIG. 14 is a flowchart showing the control of the pump motor.

First, a case where the pump motor 72 is first driven will be described with reference to FIG. 14. Here, the case where the pump motor 72 is first driven corresponds to a case where the power source SW of the printer 10 is set to ON and the printer 10 is first started. However, it may contain a case where the cartridge 62 is replaced and thus the pressure is equal to the atmospheric pressure, or a case where the printer 10 is started to be used from the state where it has been unused for a long term.

Step S10: The power source SW of the printer 10 is set to ON. Then, the actuation of the printer 10 is started. In this case, the control table stored in ROM 92 is first read in (corresponding to the read-in step).

Step S11: The pump motor 72 is actuated on the basis of the control table read in step S10, and the reciprocation of the bellows pump 74 is started (corresponding to the initial driving step).

Here, in the first driving, the pump motor 72 is first driven on the basis of the control table (for initial driving) of the Duty ratio as shown in FIGS. 11 and 13 which is stored in ROM 92.

When the pump motor 72 is first started, the time until the first H signal is transmitted does not correspond to one cycle in many cases. That is, when the other-end holding member 88 pushes the detecting lever 78*a* of the position detecting sensor 78 before the printer 10 is started, the measurement of one cycle can be accurately performed from the start. However, when the other-end holding member 88 does not push the detecting lever 78*a*, the time of one cycle cannot be accurately measured in the first cycle.

Therefore, according to this embodiment, in two cycles of a cycle until the H signal is first transmitted (corresponding to the first cycle) and a cycle from the transmission of the first H signal until the transmission of the second H signal (corresponding to the second cycle), the pump motor 72 is driven by using the control table of the Duty ratio for the above initial driving Duty ratio as the Duty ratio of the voltage. Therefore, the Duty ratio of the voltage of the pump motor 72 is changed from the third cycle stage (corresponding to the time cycle from the transmission of the second H signal until the transmission of the third H signal). That is, it is not until the second cycle that the time cycle from the H signal to the H signal can be accurately measured, and the accurate time of the second cycle can be projected to the third cycle. When the time of the first cycle can be accurately measured, the measurement time may be projected to the second cycle.

The pump motor 72 is driven for the time corresponding to only two cycles (the time until the position detecting sensor 78 transmits the second H signal) on the basis of the Duty ratio of the control table for the initial driving. At the initial stage where the pump motor 72 is started, the amount corresponding to an initial load is excessively imposed on the pump motor 72 as compared with the load imposed on the pump motor 72 after some operations have been carried out over several cycles. Therefore, the Duty ratio of the initial driving control table is normally set to a high value.

Step S12: The DC unit 96 judges whether the H Signal is received from the position detecting sensor 78 (corresponding to a part of the position detecting step). That is, when the detecting lever 78*a* is pushed by the other-end receiving portion 88*a*, the position detecting sensor 78 transmits the first H signal to the DC unit 96. When it is judged the H signal is received (in the case of Yes), the processing goes to step S13 described later. When it is judged that the H signal is not received (in the case of No), the processing returns to the step before step S12. The judgment may be carried out, not by the DC unit 96, but by CPU 91 in accordance with the circuit construction.

Step S13: When it is judged that the first H signal is received, the DC unit 96 subsequently judges whether the second H signal is received (corresponding to a part of the position detecting step). If it is judged whether the H signal is received (in the case of Yes), the processing goes to the next step S14. If no H signal is received (in the case of No), the processing returns to the step before step S13.

Step S14: The DC unit 96 calculates the cycle of the bellows pump 74 which is measured by using the position detecting sensor 78 (corresponding to the driving information calculating step). In this case, the cycle corresponds to the time from the transmission of the first H signal from the position detecting sensor 78 till the transmission of the second H signal. When the step S25 described later is passed, the calculated cycle corresponds to the time cycle between an H signal which is newly transmitted by the position detecting sensor 78 after the correction amount α1 is added and the H signal just before the new H signal.

Step S15: The DC unit 96 judges on the basis of the calculation of the cycle achieved in the above step S14 whether the rotational number of the pump motor 72 corresponding to the cycle is within a predetermined range (corresponding to a part of the correction information calculating step). That is, on the basis of the calculated cycle, the DC unit 96 calculates the rotational number of the pump motor 72 which directly corresponds to the cycle concerned, and judges whether the rotational number of the pump motor 72 thus calculated is within a target proper range. If it is judged that the rotational number is within the proper range (in the case of Yes), the processing goes to step S18 described later. If it is judged that the rotational number is not within the proper range (in the case of No), the processing goes to the next step S16. The proper range of the rotational number corresponds to the range between the upper limit of the rotational number at which occurring sounds are not so noisy and the lower limit of the rotational number calculated from a permissible time until the pressure reaches a threshold value.

Step S16: The DC unit 96 calculates the correction amount α1 on the basis of the calculated rotational number and the target information stored in ROM 82 (corresponding to a part of the correction information calculating step). That is, the correction amount α1 is calculated so that the pump motor 72 is set to a rotational number within the proper range. That is, when the rotational number of the pump motor 72 is controlled to be in the neighborhood of the target value within the proper range, the noise occurring from a mechanical portion can be reduced to a target noise level or less. Therefore, in step s16, the correction amount α1 added to the Duty ratio is determined from the relationship of the present Duty ratio of the voltage, the present rotational number and the target rotational number.

The table of the correction amount α which corresponds to the rotational number of the pump motor 72 may be stored in ROM 92 or the non-volatile memory 101 in advance. In this case, the table of the correction amount α1 may be determined by experiments or the like, and the table concerned is stored in a storage site of ROM 92 or the like. In this case, by calling the correction amount α1 for the rotational number of the table which is nearest to the calculated rotational number of the pump motor 72, the correction amount α1 can be calculated.

Furthermore, the table of the correction amount α1 as described above is not stored in advance, but the correction amount α1 may be sequentially determined by calculation. In this case, the correction amount α1 is calculated on the basis of the prediction that when a mechanical load varies, the initial rotational number of the pump motor 72 varies in proportion to variation of the load. That is, since the characteristic of the pump motor 72 is beforehand known, the mechanical load can be calculated from the initial rotational number of the pump motor 72, and the correction amount α1 for setting the rotational number of the pump motor 72 to the target rotational number can be also calculated.

In the case where the correction amount α1 is added as described above, when the difference between the calculated rotational number of the pump motor 72 and the target information (target rotational number) is large, the correction amount α1 is equal to a large value. As the difference is reduced, the correction amount α1 is equal to a smaller value.

Step S17: The DC unit 96 adds the correction amount α1 to the voltage Duty ratio (corresponding to the correcting step). That is, in the next cycle (the third cycle: the cycle from last reception of the H signal till new reception of the H signal when the step S20 is once passed), the voltage Duty ratio added with the correction amount α1 is applied to the pump motor 72. In this case, the width per one pulse of the voltage varies by only the amount corresponding to the added correction amount α1.

Step S18: The pump motor driving circuit 100 applies to the voltage Duty ratio added with the above correction amount α1 to the pump motor 72 from the next cycle, and drives the pump motor 72 (corresponding to the correction driving).

Step S19: The DC unit 96 judges whether an H signal for notifying that the pressure value exceeds a threshold value is received from the pressure sensor 76. This judgment is carried out by receiving the H signal or L signal when the pressure value exceeds the threshold value as in the case of the position detecting sensor 78 described above. If it is judged that the pressure value exceeds the threshold value (in the case of Yes), the processing goes to step S21 described later. Furthermore, if it is judged that the pressure value does not exceed the threshold value (in the case of No), the processing goes to the step S20.

Step S20: The DC unit 96 judges whether the new (next) H signal is received from the position detecting sensor 78 after the correction amount α1 is added. If it is judged that the H signal is received (in the case of Yes), the processing returns to step S14. If it is judged that no H-signal is received (in the case of No), the processing returns to the step just before the step S20 again.

Step S21: The DC unit 96 stores the voltage duty ratio added with the latest correction amount α1 in the non-volatile memory 101. At the next start time, this duty ratio is called, and the pump motor 72 is driven on the basis of the Duty ratio concerned.

Step S22: The DC unit 96 stops the actuation of the pump motor 72. In this case, the pump motor 72 is stopped at the end portion where the other-end holding member 88 pushes the detecting lever 78*a*. With this operation, when the next driving of the pump motor 72 is started, the accurate cycle measurement can be performed from the stage where the DC unit 96 first receives the H signal. However, there is a case where the bellows pump 74 stops at some midpoint due to some trouble, so that it does not push the position detecting sensor 78. It is preferable that the above case can be overcome and the accurately-measurable time of the second cycle is projected to the third cycle for even the subsequent operation of the pump motor 72.

There is a case where the Duty ratio of the voltage applied to the pump motor 72 exceeds a fixed threshold value and further increases because a child gets up to some mischief or the like, for example. In this case, when the driving of the pump motor 72 is continued while the Duty ratio is high, the heating value from the pump motor 72 is increased, and the pump motor 72 is abnormally heated, which causes failure such as breaking of wire or the like. In this case, after the driving of the step S22 is stopped, the actuation of the pump motor 72 may be stopped for a predetermined time.

Through the above-described steps, in the case where the pump motor 72 is first driven, even when the rotational number of the pump motor 72 is deviated from the target rotational number, the pump motor 72 would be converged to the target rotational number at some stage by continuing the driving of the pump motor 72 for a predetermined time.

(b) When the Pump Motor 72 is Driven after Interval

Figure 15:
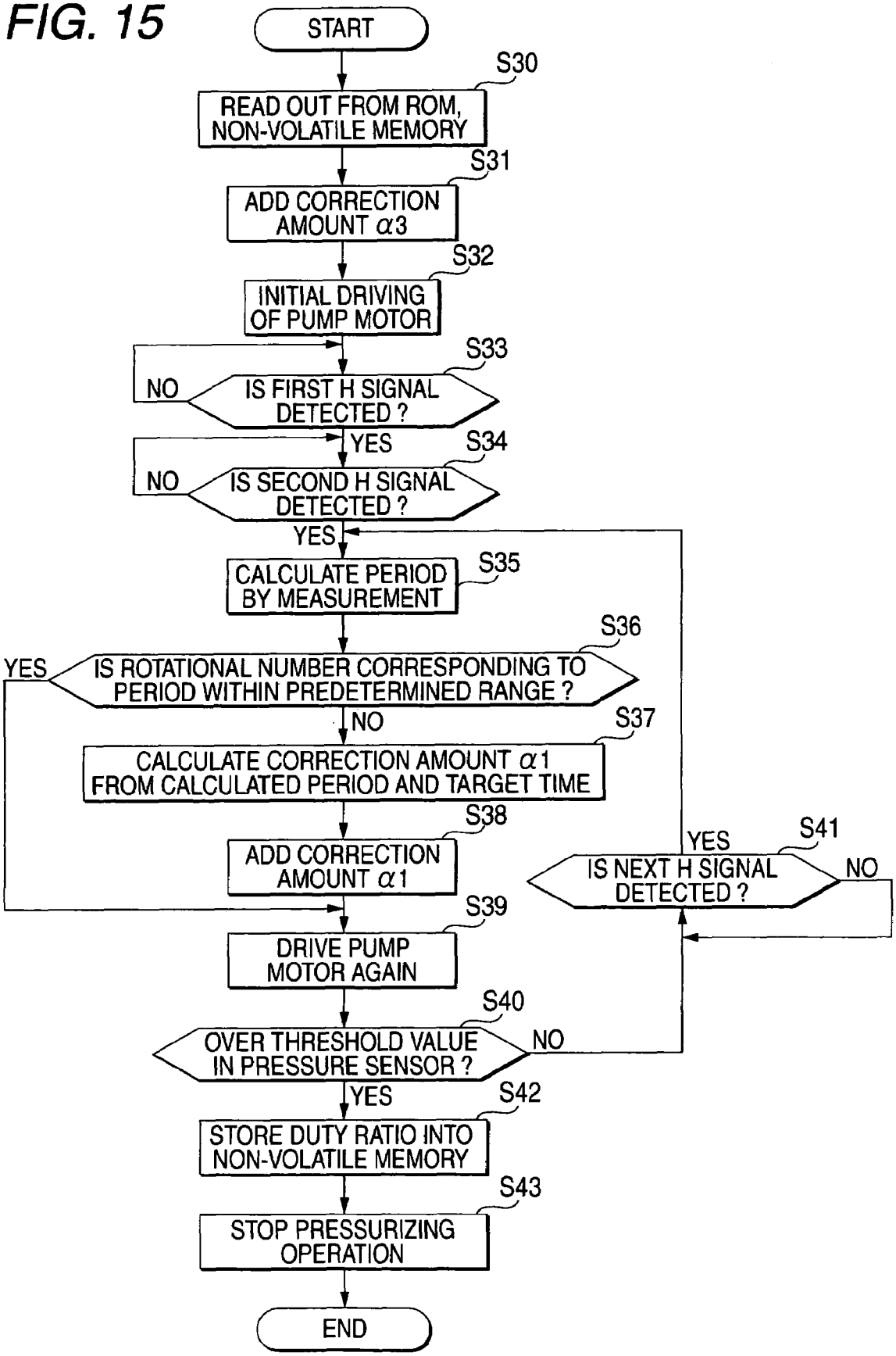
FIG. 15 is a flowchart showing the pump motor control after an interval elapses.

Next, a case where the pump motor 72 is driven after a predetermined interval passes will be described with reference to FIG. 15. As described above, "after the interval passes" corresponds to a case where the pressure is slightly lower than the threshold value of the pressure sensor 76 under the state that the power of the printer 10 is set to ON, a case where the actuation of the printer 10 is stopped for a long term irrespective of power-on/power-off and thus the pressure is greatly lower than the threshold value of the pressure sensor 76, etc.

Step S30: CPU 91 reads out the control table stored in ROM 92, and also calls the voltage Duty ratio added with the correction amount $\alpha$1 which is stored in the non-volatile memory 101.

Step S31: The Duty ratio thus called is changed, and the correction amount $\alpha$3 is added to promoting quietness at the initial driving time. The correction amount $\alpha$3 may be determined by experiments or the like as described above, or it may be determined by calculation. Since the purpose is to overcome the noise of the pump unit 70, it is desired that the correction amount $\alpha$3 to be added is set to a minus value. However, when it is expected that no noise problem occurs, $\alpha$ may be set to zero.

Step S32: The pump motor driving circuit 100 applies the voltage Duty ratio added with the above correction amount $\alpha$3 to the pump motor 72 to drive the pump motor 72.

The steps subsequent to the step S32 are the same as the steps S11 to S21. In FIG. 15, the steps S11 to S21 correspond to the steps S33 to S43. Therefore, the detailed description thereof is omitted.

Here, the pump motor 72 is driven at the second or subsequent time in the following two cases, a case where the interval is short and thus the pressure measured by the pressure sensor 76 is slightly lower than the threshold value and a case where the actuation of the printer 10 is stopped for a long term and the pressure measured by the pressure sensor 76 is greatly lower than the threshold value. Therefore, it is preferably to provide plural kinds of correction amounts $\alpha$3 in accordance with the stop time cycle of the pump motor 72. for example, when the print of the printer 10 is being executed, the correction amount $\alpha$3 is set to a correction amount $\alpha$3*a* for lowering the correction amount $\alpha$1 by about several percentages, and when the stop time cycle of the printer 10 is long and thus the pressure reduction level is high, the correction amount $\alpha$3 is set to a correction amount $\alpha$3*b* for reducing the correction amount $\alpha$1 to a further less level.

That is, when the value of the correction amount $\alpha$3*b* is set to a small value, the voltage having a large Duty ratio is applied to the pump motor 72 under the state that the pressure-based load is small. When such a voltage is applied, substantially the same voltage as the voltage under the state that the pump motor 72 is set to a proper rotational number under high pressure state before interval is applied under the pressure is low. Therefore, the rotational number of the pump motor 72 is increased, and excessively exceeds the proper rotational number, resulting in occurrence of noise. Therefore, it is required to set the correction amount $\alpha$3*b* to a larger value than the correction amount $\alpha$a.

A case where the power is shut down once and the pump motor 72 is actuated from the state that the pressure is substantially equal to the atmospheric pressure may be contained in the case where the above correction amount $\alpha$3*b* is applied.

According to the printer 10 of the first embodiment thus constructed, the control table is segmetalized to many time zones, and also the driving force of the pump motor 72 is increased/reduced in accordance with the magnitude of the load of the pump motor 72 in each time zone. Therefore, when the control table is applied to the pump motor 72, the variation (fluctuation) of the driving speed of the pump motor 72 can be suppressed. Therefore, with respect to the noise occurring from the load portions such as the bellow pumps 74 and other friction portions, occurrence of the variation of the noise can be suppressed. As described above, the noisy sound can be reduced by the amount corresponding to the suppressed variation.

In addition, the speed of the pump motor 72 at the portion where the load has a peak is set as a reference speed, and the Duty ratio in each time zone is adjusted to approach to the reference speed. Therefore, the driving speed of the pump motor 72 is adjusted to approach to a site at which the load is large and the speed is lowest. Accordingly, the noise occurring from load portions such as the bellows pump 74 and the other friction portions can be surely suppressed. That is, by setting the target setting so that the noise occurring from the load portions is out of the audible area, the occurrence of the noise can be surely reduced on the basis of the detection of the position detecting sensor 78 as the pump motor 72 is driven, and the variation of the noise can be excellently suppressed.

Furthermore, the occurrence of the noise can be suppressed by only the detection of the position detecting sensor 78. Therefore, it is unnecessary to provide an encoder or the like to detect the driving speed of the pump unit 72, and thus the cost can be suppressed from increasing.

Furthermore, as shown in FIG. 11, the H section exists in the control information of the time zone sections of the control table. Therefore, even when a locally large load acts on the pump motor 72, the pump motor 72 can be prevented from being stopped by the load concerned, so that the pump motor 72 can override the load and thus the driving can be continued. Particularly when the use term of the printer 10 is long, the effect of external disturbance factors which are not considered as initial design matters, such as degradation of the fabrication precision of the mechanical portions, etc., is more intense, and there is a tendency that it is further added to the load-increased portion. Even in such a case, the pump motor 72 can be prevented from being stopped by providing the H section to the control table. Furthermore, the driving of the pump motor 72 can be stabilized. Furthermore, it is unnecessary to increase the limit torque of the pump motor 72 in connection with the action of the large load. Therefore, it is unnecessary to use an expensive motor having a large output as the pump motor 72, so that the cost can be reduced.

The L section also exists in the control table. Therefore, the Duty ratio of the voltage is increased, and the rotational number of the pump motor 72 can be suppressed from excessively increasing to a value higher than necessary. That is, the rotational number of the pump motor 72 can be kept within fixed range. Furthermore, the noise occurring from the sliding portions such as the pump unit 70, etc. can be suppressed. Furthermore, when a locally small load acts on the pump motor 72, the rotational number can be suppressed from increasing in connection with the locally small load.

Furthermore, in the control table described above, the H section and the L section are alternately repeated. The rotational speed of the pump motor 72 can be prevented from increasing to a value higher than necessary by the combination of the repetition concerned and the inertia of the pump motor 72, etc., and the pump motor can be rotated at the target rotational speed.

Still furthermore, in this embodiment, the average within one cycle of the Duty ratio applied to the pump motor 72 is larger than the average within one cycle of the Duty ratio necessary to drive the pump motor 72. Therefore, the pump motor 72 can be surely driven. In addition, even when the load of the pump motor 72 is slightly varied due to variation of the outside air temperature, increase of friction, etc., the pump motor 72 can be surely driven. Furthermore, even when a load larger than an estimated load acts on the pump motor 72, the pump motor 72 can be started.

Furthermore, the PWM control is carried out for the control of the pump motor 72. Therefore, the rotational number of the pump motor 72 can be adjusted by merely adjusting the Duty ratio of the pulse voltage, so that the rotational number of the pump motor 72 can be accurately controlled although it is simple. Furthermore, the adjustment of the Duty ratio is carried out by individually increasing/reducing the Duty ratio in the control table on the basis of the variation of the load within one cycle of the bellows pump 74 which is measured in advance so that the variation of the driving speed is reduced. Therefore, the minute control can be performed within one cycle of the bellows pump 74, and the variation of the speed can be further suppressed.

Furthermore, the position detecting sensor 78 detects the position in the reciprocal motion of the bellows pump 74 at the expansion end side of the bellows pump 74, and transmits the H signal. Therefore, when the position detecting sensor 78 once detects the position of the bellows pump 74 and then detects the position of the bellows pump 74 again, the start end and the terminal of one cycle of the bellows pump 74 can be measured. Then, by measuring the time cycle therebetween, the time of one cycle of the bellows pump 74 can be accurately measured.

In addition, in the first embodiment, the position detecting sensor 78 stops the driving of the pump motor 72 at the expansion end side of the bellows pump 74. Therefore, when the pump motor 72 is next driven, if the DC unit 96 receives the first H signal from the position detecting sensor 78, the time elapsing until the detection concerned is the first cycle. That is, at the first position detecting stage, the accurate cycle measurement can be performed, and the quietness can be more early established.

The first embodiment of the present invention has been described, however, various modifications other than the above embodiment may be made in the present invention. These modifications will be made hereunder.

In the first embodiment, the detection signal is transmitted from the position detecting sensor 78, the time length of one cycle measured by the position detecting sensor 78 is calculated on the basis of the detection signal in the DC unit 96, and the DC unit 96 calculates the correction amount $\alpha 1$ on the basis of the measured time length of one cycle. However, the embodiment may be modified so that the time length for which the H signal is transmitted from the position detecting sensor 78 (that is, the time length for which the detecting lever 78*a* is pushed in and the H signal is transmitted) is measured, and the correction amount (correction information) is calculated on the basis of the time length.

Here, the time length of the transmission of the H signal occupies a predetermined rate with respect to the measured time length of one cycle. Therefore, in the case of the above-described construction, by measuring the time length for which the H signal is transmitted, the time length of one cycle of the bellows pump 74 can be estimated. On the basis of the estimation concerned, the correction amount can be calculated from the stage where the bellows pump 74 starts to move and the H signal is first transmitted. By adding the correction amount to the voltage Duty ratio, the driving speed of the pump motor 72 can be made to approach to the target driving speed from the initial stage of the driving of the bellows pump 74.

Furthermore, in the first embodiment, the average of the Duty ratio of the control table is set to a value larger than the average of the Duty ratio necessary for the driving of the pump motor 72. However, the average of the Duty ratio of the control table may be made coincident with the Duty ratio necessary for the driving of the pump motor 72.

Still furthermore, in the above-described embodiment, only at the initial driving time, the dispersion degree in the vertical direction (amplitude direction) of the H section and the L section may be set to a large level than that at the other driving time than the initial driving time. According to this setting, the pump motor 72 can be prevented from being stopped at the initial driving time when a large load frequently acts on the pump motor 72.

Further, according to the printer 10 of the second embodiment thus constructed, the control table corresponds to the cycle of the reciprocating motion of the bellows bump 74, and also the Duty ratio in the last section of one cycle is set to a higher value than the Duty ratio in the initial time zone section. Therefore, by applying the control table to the pump motor 72, the output of the motor at the Duty ratio of the last portion is increased. Accordingly, even when the load acting on the pump motor 72 at the last portion is large, the pump motor 72 can overcome the load. Particularly when the pressure is sufficiently increased, the pump motor 72 can overcome the large load corresponding to the high pressure.

Accordingly, there can be prevented occurrence of such a disadvantage that when the pump motor 72 is next started, action of a large load on the pump motor 72 is continued and thus the pump motor 72 cannot start its motion or it takes much time for the pump motor 72 to start its motion. Therefore, it can be prevented that the phase is displaced because the pump motor 72 cannot start its motion, and also it can be prevented that a large voltage/current is applied to a load-small portion and thus the rotational number of the pump motor 72 is varied. Furthermore, since the variation of the rotational number of the pump motor 72 is prevented, variation of noises occurring from load portions such as the bellows pump 74 and other friction portions can be suppressed, so that the noisy sounds can be reduced.

In addition, the speed of the pump motor 72 at the load-peak portion is set to a reference speed, and the Duty ratio in each time zone is adjusted so that the speed approaches to this reference speed. Therefore, the pump motor 72 is adjusted in driving speed so as to approach to a site at which the load is large and the speed is low. Accordingly, the noise occurring from the load portions such as the bellows pump 74, etc. can be surely suppressed. If the target information is set so that the occurring noise is out of the audible area, the occurrence of the noise can be surely reduced on the basis of the detection of the position detecting sensor 78, and the variation of the noise can be excellently suppressed.

Furthermore, the occurrence of the noise can be suppressed by only the detection of the position detecting sensor 78. Accordingly, it is unnecessary to provide an encoder or the like to detect the driving speed of the pump motor 72, and the rise-up of the cost can be suppressed. Furthermore, it is unnecessary to increase the limit torque of the pump motor 72 in connection with action of a large load, and thus it is not required to use an expensive motor having a large output, so that's the cost can be reduced.

In this second embodiment, the Duty ratio in the last section is higher than the average Duty ratio of one cycle of the control table. Accordingly, the output from the pump motor 72 is sufficiently large, and even when the load is high, the pump motor 72 can sufficiently overcome the load.

Furthermore, when the driving speed of the motor exceeds a fixed threshold value, the Duty ratio of the before-last section is set to be lower than the initial Duty ratio of the control profile. Therefore, the driving force of the pump motor 72 is reduced by the Duty ratio of the before-last section, whereby the driving speed of the pump motor 72 can be reduced to the threshold value or less and the speed variation can be reduced.

Furthermore, the PWM control is carried out in the control of the pump motor 72. Therefore, the rotational number of the pump motor 72 can be adjusted by merely adjusting the Duty ratio, and the control can be easily and accurately performed. The adjustment of the Duty ratio is carried out by individually increasing/reducing the Duty ratio in the control table on the basis of the variation of the load within one cycle of the bellows pump 74 which is measured in advance. Therefore, the fine control can be performed within one cycle of the bellows pump 74, and the variation of the speed can be further suppressed.

Furthermore, the position detecting sensor 78 detects the position in the reciprocal motion of the bellows pump 74 at the expansion end side of the bellows pump 74, and transmits the H signal. Therefore, when the position detecting sensor 78 once detects the position of the bellows pump 74 and then detects the position of the bellows pump 74 again, the start end and the terminal of one cycle of the bellows pump 74 can be measured. Then, by measuring the time cycle therebetween, the time of one cycle of the bellows pump 74 can be accurately measured.

In addition, in the second embodiment, the position detecting sensor 78 stops the driving of the pump motor 72 at the expansion end side of the bellows pump 74. Therefore, when the pump motor 72 is next driven, if the DC unit 96 receives the first H signal from the position detecting sensor 78, the time elapsing until the detection concerned is the first cycle. That is, at the first position detecting stage, the accurate cycle measurement can be performed, and the quietness can be more early established.

The second embodiment of the present invention has been described, however, various modifications other than the above embodiment may be made in the present invention. These modifications will be made hereunder.

In the second embodiment, the Duty ratio of the last section is increased in the control table sectioned into many time zones. However, the Duty ratio of the last portion may be increased in a control table which is not sectioned into many time zones. For example, when the Duty ratio is set so that the control table of one cycle is along a predetermined curved line, only the Duty ratio of the last portion of this cycle may be increased. Likewise, when the control table is along the curved line concerned, the Duty ratio of a portion which is slightly preceding to the last portion and corresponds to the before-last section may be set to be smaller than the Duty ratio of the initial portion.

In the second embodiment, the Duty ratio of the last section corresponds to the last portion, and only the Duty ratio of the last section is increased. However, several sections of time zone sections containing the last section are made to correspond to the last portion, and the Duty ratio of that portion may be collectively increased. Likewise, the Duty ratio of a portion which corresponds to the before-last section and is slightly preceding to the last portion may be collectively increased.

Furthermore, in the second embodiment, the position detecting sensor 78 transmits the detection signal, the DC unit 96 calculates the time length of one cycle actually measured by the position detection sensor 78 on the basis of the detection signal concerned, and the DC unit 96 also calculates the correction amount $\alpha$1 on the basis of the actually measured one-cycle time length. However, a modification may be made so that the time length for which the H signal is transmitted by the position detecting sensor 78 (that is, the time length for which the detecting lever 78*a* is pushed and the H signal is transmitted) is measured and the correction amount (correction information) is calculated on the basis of the time length concerned.

Here, the time length for which the H signal is transmitted occupies a predetermined rate with respect to the actually measured one-cycle time length. In the case of the above construction, by measuring the time length for which the H signal is transmitted, the one-cycle time length of the bellows pump 74 can be predicted. According to the prediction concerned, the correction amount can be calculated from the stage where the bellows pump 74 starts its motion and the H signal is first transmitted. By adding the correction amount concerned to the voltage Duty ratio, the driving speed of the pump motor 72 can be approached to the target driving speed from the first stage of the driving of the bellows pump 74.

Furthermore, in the second embodiment, the average of the Duty ratio of the control table is set to be larger than the average of the Duty ratio necessary for the driving of the pump motor 72. However, the average of the Duty ratio of the control table may be set to be coincident with the Duty ratio necessary for the driving of the pump motor 72.

Additionally in the above-described first and second embodiments, the correction amount $\alpha$1 is the same irrespective of the residual amount of ink of the cartridge 62. However, the correction amount $\alpha$1 may be changed in accordance with the ink residual amount. Here, the cartridge 62 may be provided with a memory such as EEPROM or the like (not shown), and the ink residual amount is stored there. By reading out the ink residual amount stored in the memory, the DC unit 96 determines a correction variation amount $\beta$ to be added to the correction amount $\alpha$1. The read-out of the ink residual amount and the calculation of the correction variation amount $\beta$ may be carried out at any stage insofar as it is before the step S20 of FIG. 12.

For the cartridge 62 described above, there is adopted such a construction that ink is stored in a first back-shaped member, air is made to flow into a second back-shaped member and the first bag-shaped member and the second bag-shaped member are adjacent to each other. In the case where the construction as described above is adopted, if the ink residual amount is small, the second bag-shaped member is brought into contact with the first bag-shaped member under the state that no pressure is applied to the first bag-shaped member. Therefore, air is more easily introduced as compared with a case where the ink residual amount is large. In this case, the rotational number of the pump motor 72 is apt to increase, and thus the noise problem occurs. Therefore, when the ink residual amount is small, the value of the correction variation amount $\beta$ is set to a larger value in the minus direction as compared with the case where the ink residual amount is large.

The correction variation amount $\beta$ thus calculated is added after the correction amount $\alpha$1 is calculated. Accordingly, the voltage of the total Duty ratio of the correction amount $\alpha$1 and the correction variation amount $\beta$ is applied to the pump motor 72, and the pump motor 72 is driven. According to the above operation, the noise occurring from the load portions can be suppressed irrespective of the ink residual amount.

Furthermore, in the above-described first and second embodiments, the control table as the fixed value stored in ROM 92 is used as the voltage of the first and second cycles applied to the pump motor 72. However, there is a situation that the variation of the rotational number is great and unstable every time the printer 10 is started when the printer 10 is started, the fixed value concerned may be changed in connection with the next starting of the printer 10.

In the above-described first and second embodiments, the DC motor is used as the pump motor 72. However, the pump motor 72 is not limited to the DC motor. If the control based on the PWM system is possible, the present invention could be applied to a driving mechanism using an AC motor or the like.

Furthermore, in the above-described first and second embodiments, ink is used as liquid, the cartridge 62 is used as the liquid supply source and the liquid container 41 is used as the container. However, the liquid is not limited to ink, and it may be processing solvent for carrying out various kinds of processing on semiconductor, etc., cleaning liquid or the like. In these cases, the liquid supply source does not serve as the cartridge 62, but as a tank for storing the processing solvent or the cleaning liquid.

In the above-described first and second embodiments, the pump control mechanism is applied to the domestic printer 10. However, the application of the pump control mechanism of the present invention is not limited to the printer 10, but it may be applied to a large-scaled printer for business. Furthermore, the present invention may be applied to equipment other than the printer, such as the compressor of an air conditioner, etc.

Furthermore, in the above-described first and second embodiments, the driving information is set to each cycle, the rotational number at each cycle and the voltage Duty ratio at each cycle. The target information is set to each target cycle of the pump motor 72 and the rotational number at the cycle. However, the driving information/target information is not limited to the above information, and the flow rate of ink may be set as the driving information/target information.

Furthermore, in the above-described first and second embodiments, the correction is to add the correction amounts $\alpha 1$, $\alpha 3$ (containing addition of a minus value). However, when the correction amount $\alpha 1$, $\alpha 3$ is a predetermined correction coefficient, the correction coefficient may be multiplied to the Duty ratio. Furthermore, the control information, the correction information, the post-correction control information, the second correction information, etc. are not limited to the case where a fixed numerical value is added, but they may be information for changing the control timing or the like which is executed by the control program.

Furthermore, in the above-described first and second embodiments, the driving of the pump motor 72 is controlled by the PWM control. However, the driving control of the pump motor 72 is not necessarily carried out by the PWM control. For example, when the PWM control is not carried out and a predetermined voltage value is applied, the current value flowing in the pump motor 72 may be adjusted by properly adjusting the voltage value concerned. Furthermore, the present invention may be applied to a case where the pump motor 72 is not subjected to voltage control, but subjected to current control.

What is claimed is:

1. A pump control mechanism comprising:

a pump unit that feeds liquid stored in a liquid supply source to a container and has: a pump member; and a motor that drives the pump member and is controlled based on control information; and an information memory that stores: a control table having a plurality of the control information; and target information corresponding to a target driving speed of the motor when the motor is driven, wherein the control table includes time zone sections corresponding to one driving cycle of the pump member, each of the time zone sections having the control information for increasing or decreasing a driving force of the motor in accordance with a magnitude of a load of the motor, wherein the time zone sections include a control information increasing section for locally increasing the driving force and a control information reducing section for locally reducing the driving force, wherein the control table contains an area where the control information increasing section and the control information reducing section are alternately repeated, wherein an average of the control information in the area is set to be larger than the control information required to drive the motor in the area, wherein the control information is a duty ratio for carrying out PWM control at a pulse voltage applied to the motor, wherein the duty ratio of the last section in the time zone sections corresponding to one driving cycle of the pump member is set to the control information increasing section, and wherein the duty ratio of the last section is higher than the duty ratio of the initial section in the time zone sections and is lower than an average of the duty ratio in the time zone sections.

2. The pump control mechanism according to claim 1, wherein the control information increasing section is provided in accordance with a case where a large load locally acts on the motor.

3. The pump control mechanism according to claim 1, wherein the control information increasing section is provided at the last section for increasing a driving force of the motor as compared with that at the initiali section.

* * * * *